US009701385B1

(12) United States Patent
Majumder

(10) Patent No.: US 9,701,385 B1
(45) Date of Patent: Jul. 11, 2017

(54) MULTI-FUNCTIONAL POWERHOUSE TUG AND BARGE (PTB) SYSTEM EMPLOYED IN AN ARTICULATED TUG AND BARGE SYSTEM AND ASSOCIATED USE THEREOF

(71) Applicant: Mizanur Rahman Majumder, East Amherst, NY (US)

(72) Inventor: Mizanur Rahman Majumder, East Amherst, NY (US)

( * ) Notice: Subject to any disclaimer, the term of this patent is extended or adjusted under 35 U.S.C. 154(b) by 0 days.

(21) Appl. No.: 14/827,251

(22) Filed: Aug. 14, 2015

Related U.S. Application Data

(60) Provisional application No. 62/037,724, filed on Aug. 15, 2014.

(51) Int. Cl.

| | |
|---|---|
| ***B63B 35/70*** | (2006.01) |
| ***B63H 21/17*** | (2006.01) |
| ***B63B 35/66*** | (2006.01) |
| ***B63H 23/02*** | (2006.01) |

(52) U.S. Cl.
CPC ..... *B63H 21/17* (2013.01); *B63B 35/66* (2013.01); *B63H 23/02* (2013.01); *B63B 35/665* (2013.01)

(58) Field of Classification Search
CPC .. B63H 21/17; B63H 21/20; B63H 2021/202; B63H 2021/205; B63H 2021/207; B63B 35/66; B63B 35/68; B63B 35/70
See application file for complete search history.

(56) References Cited

U.S. PATENT DOCUMENTS

| | | | | |
|---|---|---|---|---|
| 6,260,500 | B1 * | 7/2001 | Coakley | B63B 35/665 114/242 |
| 6,357,375 | B1 * | 3/2002 | Ellis | B63H 21/22 114/144 R |
| 8,894,454 | B2 * | 11/2014 | Lorang | B63B 35/70 440/8 |
| 2006/0053806 | A1 * | 3/2006 | Tassel | B63B 25/16 62/48.1 |
| 2009/0156068 | A1 * | 6/2009 | Barrett | B63H 21/20 440/3 |
| 2012/0226636 | A1 * | 9/2012 | Perez | B63B 35/70 705/500 |

FOREIGN PATENT DOCUMENTS

| | | | | |
|---|---|---|---|---|
| GB | 1003997 A | * | 9/1965 | B63B 21/56 |

* cited by examiner

*Primary Examiner* — Andrew Polay
(74) *Attorney, Agent, or Firm* — Ashkan Najafi

(57) ABSTRACT

A PTB system includes a vessel (barge) having propulsion and maneuvering gears (shaft & propeller) without an engine or power source. The PTB system further includes a tug having a generator and a fuel source that powers the generator for supplying a power pack to power the propulsion and maneuvering gears onboard the barge. The propulsion and maneuvering gears may be remotely controlled and the vessel will be powered by the tug's power pack, and not from a generator (or other power source) onboard the vessel. The tug will be connected at the bow of the vessel rather than at the aft of the vessel (like in a traditional ATB system), wherein the vessel's entire propulsion power comes from the tug's onboard power pack. The vessel will push the smaller tug, which supplies all its propulsion power to the vessel.

15 Claims, 21 Drawing Sheets

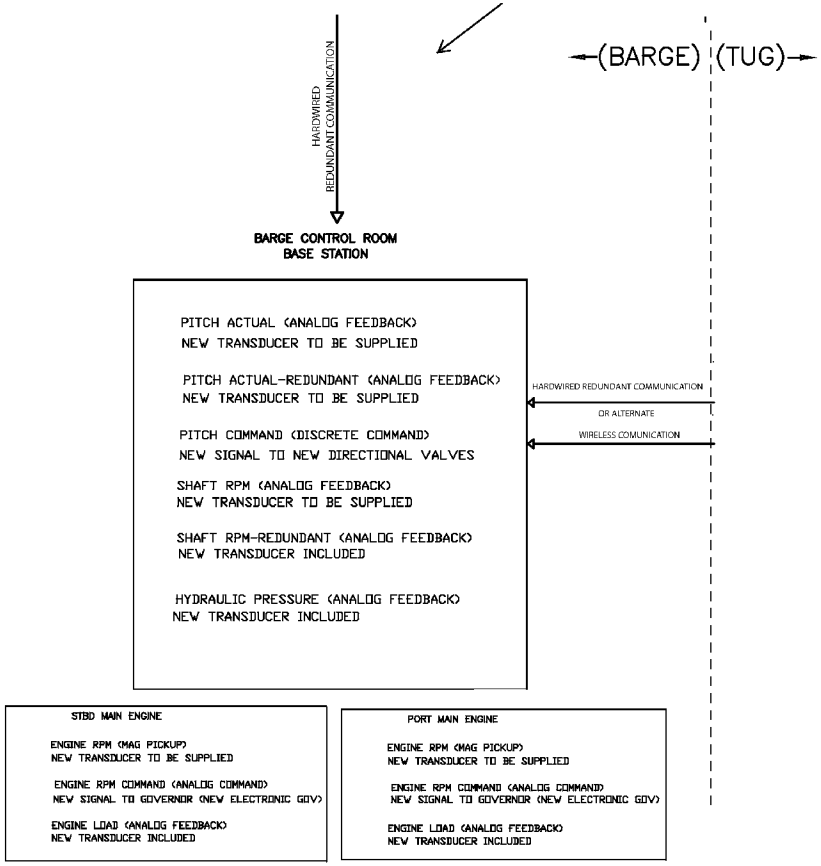
Figure 18 continued (prior art)

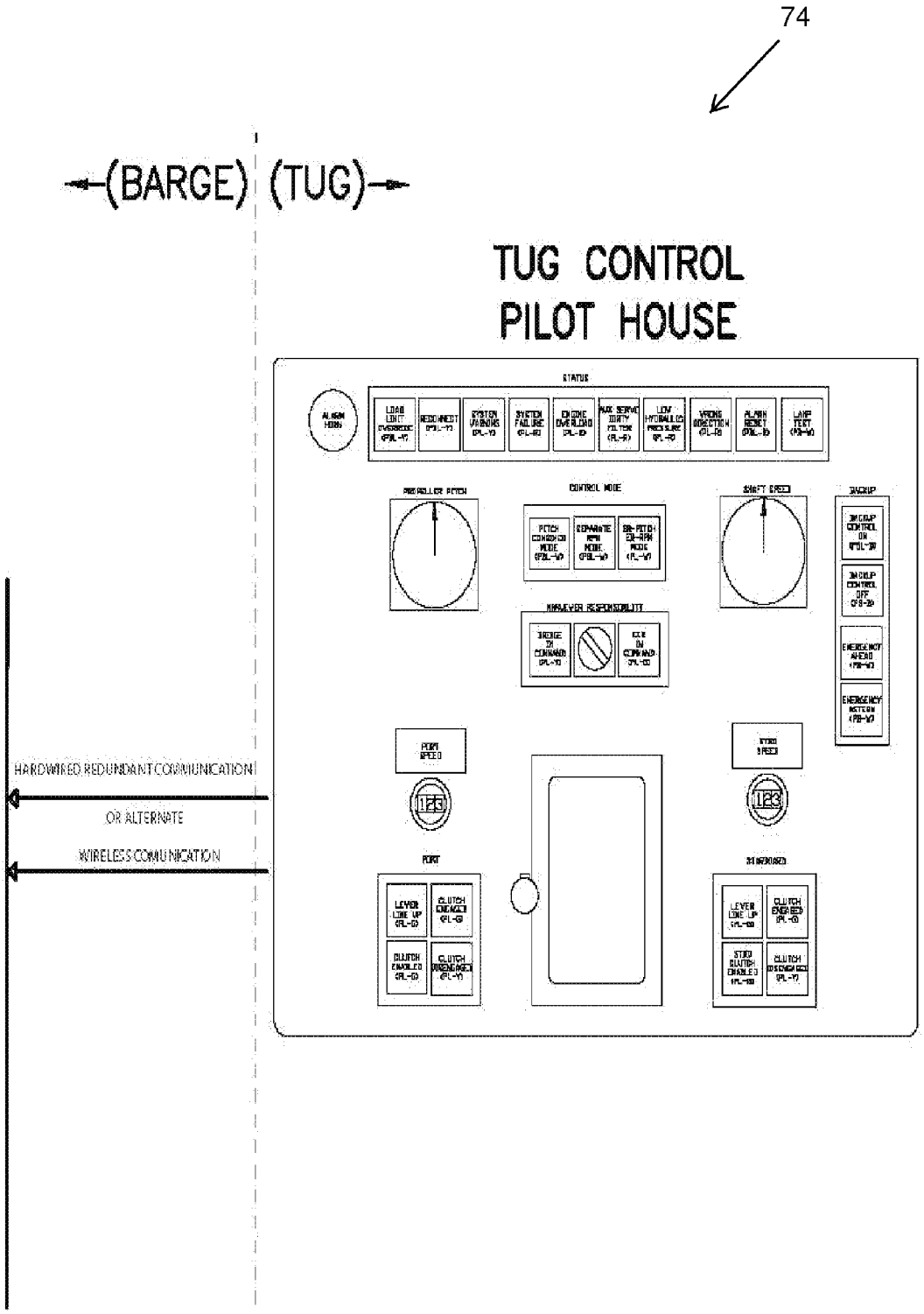
FIGURE 18 CONTINUED (PRIOR ART)

MULTI-FUNCTIONAL POWERHOUSE TUG AND BARGE (PTB) SYSTEM EMPLOYED IN AN ARTICULATED TUG AND BARGE SYSTEM AND ASSOCIATED USE THEREOF

CROSS REFERENCE TO RELATED APPLICATIONS

This application claims the benefit of U.S. Provisional Application No. 62/037,724 filed Aug. 15, 2014, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE DISCLOSURE

Technical Field

Exemplary embodiment(s) of the present disclosure relate to articulated tugboat (tug) and barge (vessel) systems (ATB systems) and, more particularly, to a multi-functional powerhouse tug and barge (PTB) propulsion system for providing power, via a power-pack onboard the tug, to the barge.

Prior Art

A number of maritime companies around the world are virtually stuck with several vessels in their fleet that they can neither run nor be disposed. This is mainly because they are not economic to run or does/will not meet environmental compliance, though their overall structural condition may be quite good. These companies are spending thousands of dollars just to keep them in a berth where they are rotting day by day. These vessels need large investment to make them environmentally compliant to run in the developed world where regulatory requirements are quite stringent. Scrapping or writing off some of these vessels may make the financial statement for the company look bad. Selling them may be a competitive disadvantage if falls in wrong hand. Putting them back to service is the only way out.

The second motivation comes from the idea of developing a design concept for both existing retrofit and also for new designs by lowering crew requirement and yet achieving highest possible propulsive efficiency and operational flexibility. Self-propelled vessels need more crews compared to an unmanned vessel of the same cargo capacity. The best option is to find how to convert an existing self-propelled vessel into an unmanned vessel to reduce crewing cost and find a new concept of operating it in the most efficient way. Higher crew cost has already forced some companies switch to tug-barge system from regular self-propelled vessels.

The following are major operational costs comparison between self-propelled vessel and conventional tug-barge system. Standard major operational cost heads for a self-propelled vessel: Crew wage & benefits: 40 to 45%; and Fuel cost: 40 to 45%. Standard major operational cost heads for a tug & barge: Crew wage & benefits: 25 to 30%; and Fuel cost: 50 to 55%. One of the major problems with existing tug-barge system is their operational risk in rough seas compared to that of traditional vessels. The resulting downtime due to weather delays sometime outweighs the saving from smaller crew size.

From all the above considerations an economically viable option has to be thought about to convert these vessels or go for new construction where it will be easy to comply with continually changing regulatory and environmental requirements, as well as get quicker return on investment. For greater acceptability this concept will have to produce a highly flexible system for multi-purpose operational scenarios.

Issues with the Existing Vessels and their Configurations

The current configuration of a conventional tug-barge system includes a barge at the front, with a tug at an aft notch, connected by some sort of connection between them. The barge does not have any propulsion system and the tug with its propulsion system pushes the barge. FIG. 1 is a perspective view of a conventional barge 90 (prior art) employed in a conventional tug-barge system. There are a number of issues with this system: it needs an expensive and complicated notch at the stern of the barge which may cost huge initial investment. FIG. 2 is a perspective view of a conventional complicated notch 91 (prior art) on existing tug-barge system, which also needs a robust & complicated connection between the tug and barge, as smaller tug pushes large barge. This also a huge initial investment.

FIG. 3 is a perspective view of a conventional complicated articulation system 92 (prior art) in existing tug-barge system, which experiences a lack of propulsive efficiency due to highly non-streamlined transition between the tug and the barge causing added premium on operational cost. FIG. 4 is a perspective view of a conventional non-hydrodynamic transition interface 93 (prior art) between a tug & barge in conventional articulated tug-barge systems (ATB) and conventional integrated tug-barge systems (ITB), which has a smaller propulsive gears 95 option in the tug boat compared to that possible on the barge 94, again causing premium on operational cost from lower propulsive efficiency. See also FIGS. 5 and 5*a* (prior art).

FIG. 6 is a perspective view of a line-of-sight issue 96 in conventional ATB/ITB systems, which experience severe operational issue due to the line of sight from the tug's pilothouse over the barge, needing high pilothouse on the tug. Deck cargo even compounds this navigational and safety issue. FIG. 7 is a perspective view of a conventional tug 97 (prior art) with a high pilothouse and high center of gravity that becomes tender/unstable. The articulation system of such conventional tugs makes it difficult to operate at higher sea states, normally beyond sea state 3. Due to high pilothouse, the tug becomes very tender or unstable when separated from the barge. Therefore, it is difficult to keep continued compliance with changing environmental regulations. The tug-barge system has limited flexibility in operation due to its configuration etc.

Because of non-streamlined connection between the tug and barge in a conventional system, its propulsive efficiency is less than that of a similar sized ship, resulting in less speed for the same power used. Despite of all the advantages of a ship over a tug-barge system, the tug-barge system in most cases still proves to be more economical just because of its significantly smaller crew requirement. One of the great advantages of a tug-barge system is that the tug is readily replaceable with another one if their propulsion system fails. This is not in the case of a ship, where the propulsion engine failure virtually ceases its operation.

Accordingly, a need remains for a multi-functional tugboat in order to overcome at least one prior art shortcoming. The exemplary embodiment(s) satisfy such a need by providing that a multi-functional powerhouse tugboat employed in an ATB system that is convenient and easy to use, lightweight yet durable in design, versatile in its applications, and designed for providing power to the barge (vessel) via a power-pack onboard the tug. The primary modification achieved by removal of the accommodation and propulsion engines discussed above will convert a vessel into an unmanned carrier with no propulsion engine, just like a barge.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a powerhouse tug and barge (PTB) propulsion system for providing power from a tug to a barge. These and other objects, features, and advantages of the non-limiting exemplary embodiment(s) are provided by a PTB propulsion system including a barge having a first drive, and a first electrical propulsion and maneuvering gear in communication with the first drive. A tug is in electrical communication with the barge and detachably coupled thereto. Such a tug includes a first controller in operative communication with the first drive, a second controller, a fuel supply, and an electrical power generating source communicatively coupled to the fuel supply. The electrical power generating source is in operative communication with the second controller. Notably, a soft connection physically and electrically couples the tug to the barge such that the tug is pushed and maneuvered by the barge. Advantageously, the electrical power generating source is configured to transfer power to the first drive thereby driving the first electrical propulsion and maneuvering gear such that the barge does not need an onboard power source for independently supplying power to the first drive.

In a non-limiting exemplary embodiment, the electrical power generating source includes a generator, a switch board in communication with the generator and located downstream therefrom, and a transformer in communication with the generator and located downstream therefrom.

In a non-limiting exemplary embodiment, the electrical power generating source further includes a drive in communication with the transformer and located downstream therefrom, and a second electrical propulsion and maneuvering gear in communication with the drive and located downstream therefrom. Notably, the first electrical propulsion and maneuvering gear is independently controlled from the second electrical propulsion and maneuvering gear.

In a non-limiting exemplary embodiment, the second electrical propulsion and maneuvering gear includes an electric azimuth system.

In a non-limiting exemplary embodiment, the fuel supply includes a non-conductive energy source.

In a non-limiting exemplary embodiment, the non-conductive energy source includes liquid natural gas.

In a non-limiting exemplary embodiment, the ATB propulsion system further includes a third controller remotely located from the first controller and the second controller. Such a third controller is in communication with the first controller and the second controller for selectively controlling an operating mode of the first electrical propulsion and maneuvering gear as well as the second electrical propulsion and maneuvering gear.

The present disclosure further includes a method for utilizing a powerhouse tug and barge (PTB) propulsion system for providing power from a tug to a barge. Such a method includes the steps of: providing a barge having a first drive, and a first electrical propulsion and maneuvering gear in communication with the first drive; providing a tug in electrical communication with the barge such that the barge is detachably coupled to the tug. Such a tug includes a first controller in operative communication with the first drive, a second controller, a fuel supply, and an electrical power generating source communicatively coupled to the fuel supply. The electrical power generating source is in operative communication with the second controller.

The method further includes the steps of: providing a soft connection and thereby physically and electrically coupling the tug to the barge such that the tug is pushed and maneuvered by the barge; and the electrical power generating source transferring power to the first drive thereby driving the first electrical propulsion and maneuvering gear such that the barge does not need an onboard power source for independently supplying power to the first drive.

There has thus been outlined, rather broadly, the more important features of non-limiting exemplary embodiment (s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
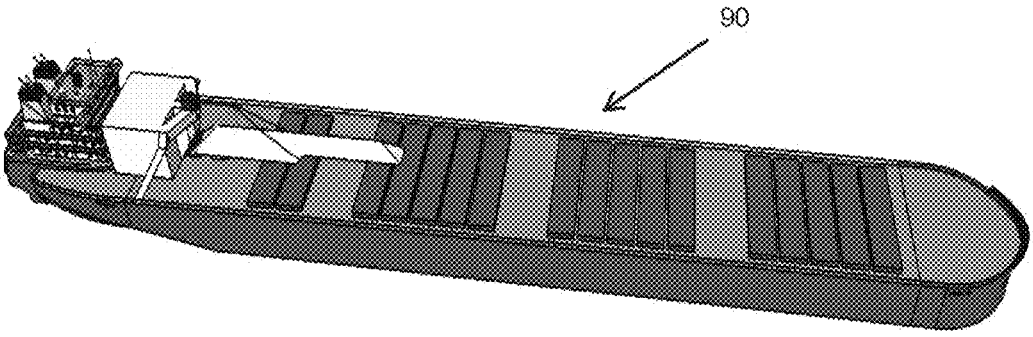
Figure 1 (prior art)
FIG. 1 is a perspective view of a conventional tug-barge system (prior art)
Figure 2:
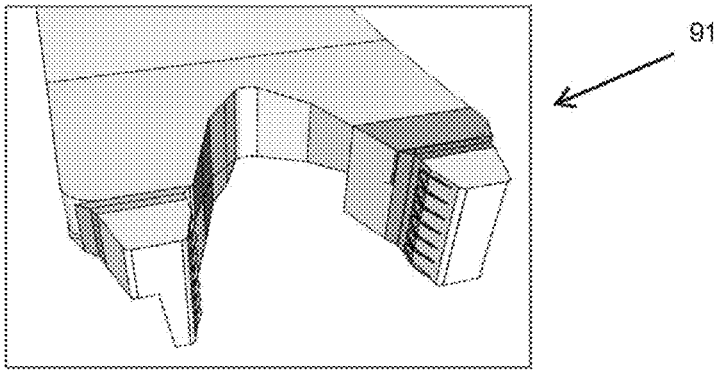
Figure 2 (prior art)
FIG. 2 is a perspective view of a conventional complicated notch on existing tug-barge system (prior art)
Figure 3:
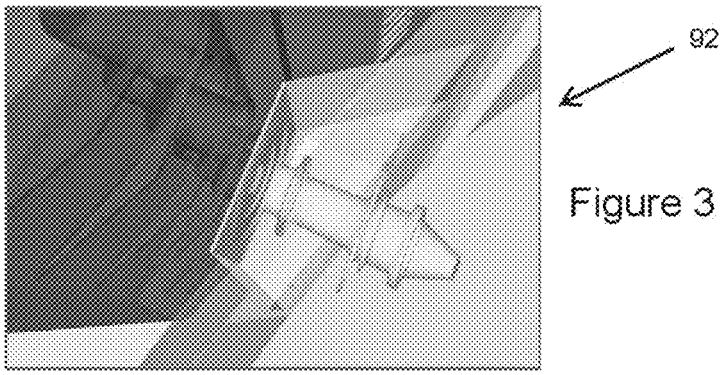
Figure 3 (prior art)
FIG. 3 is a perspective view of a conventional complicated articulation system in existing tug-barge system (prior art)
Figure 4:
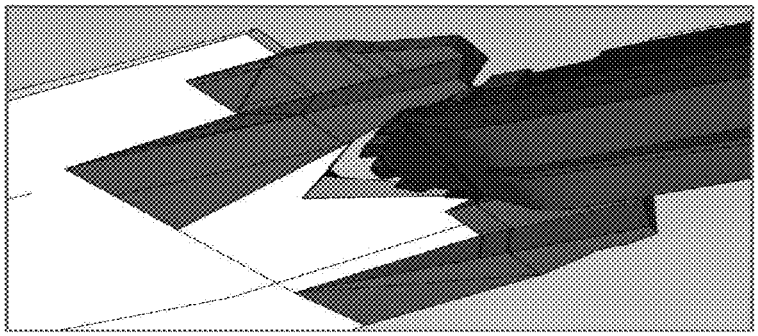
Figure 4 (prior art)
FIG. 4 is a perspective view of a conventional non-hydrodynamic transition interface between a tug & barge in conventional articulated tug-barge systems (ATB) and conventional integrated tug-barge systems (ITB) (prior art)
Figure 5:
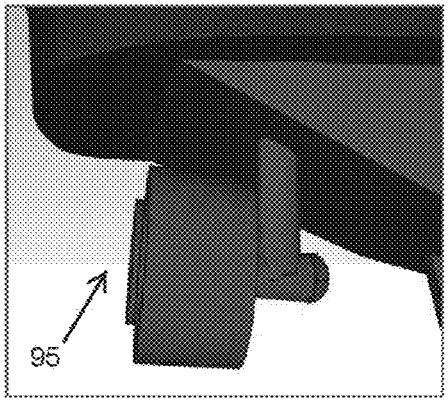
Figure 5 (prior art)
FIG. 5 is a perspective view of a conventional propulsion gear configuration for a conventional tug (prior art)
Figure 5A:
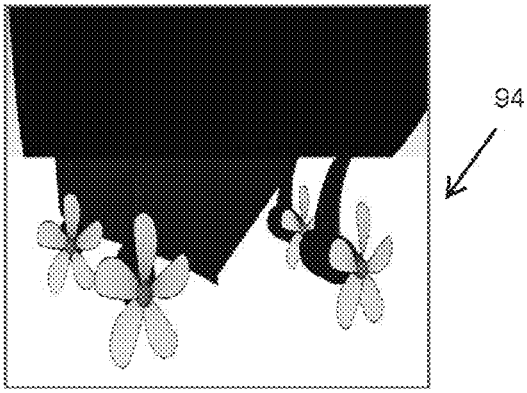
Figure 5a (prior art)
Figure 6:
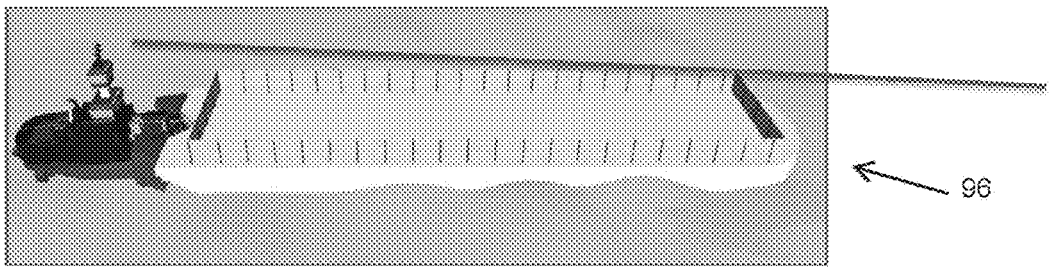
Figure 6 (prior art)
Figure 7:
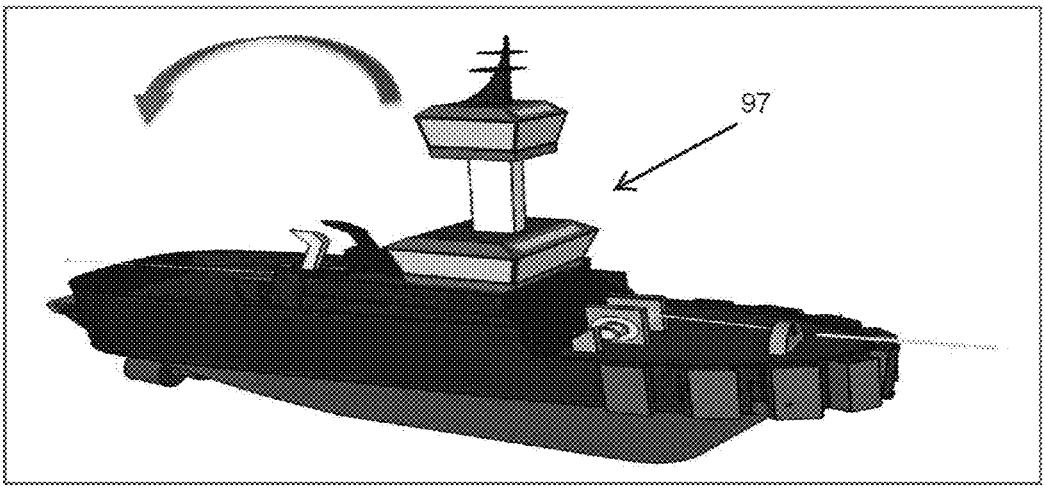
Figure 7 (prior art)
Figure 8:
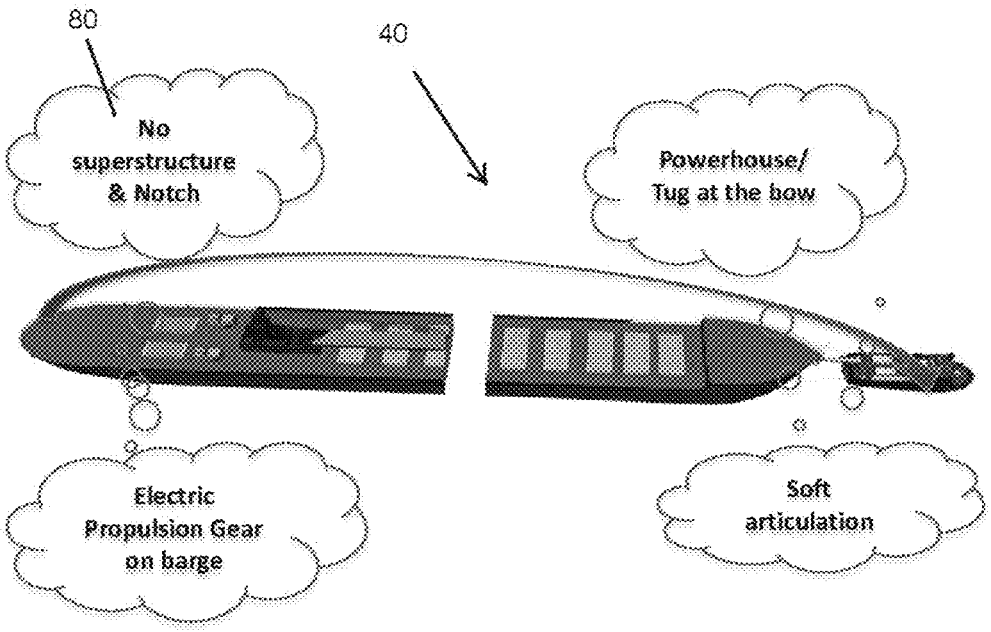
Figure 9:
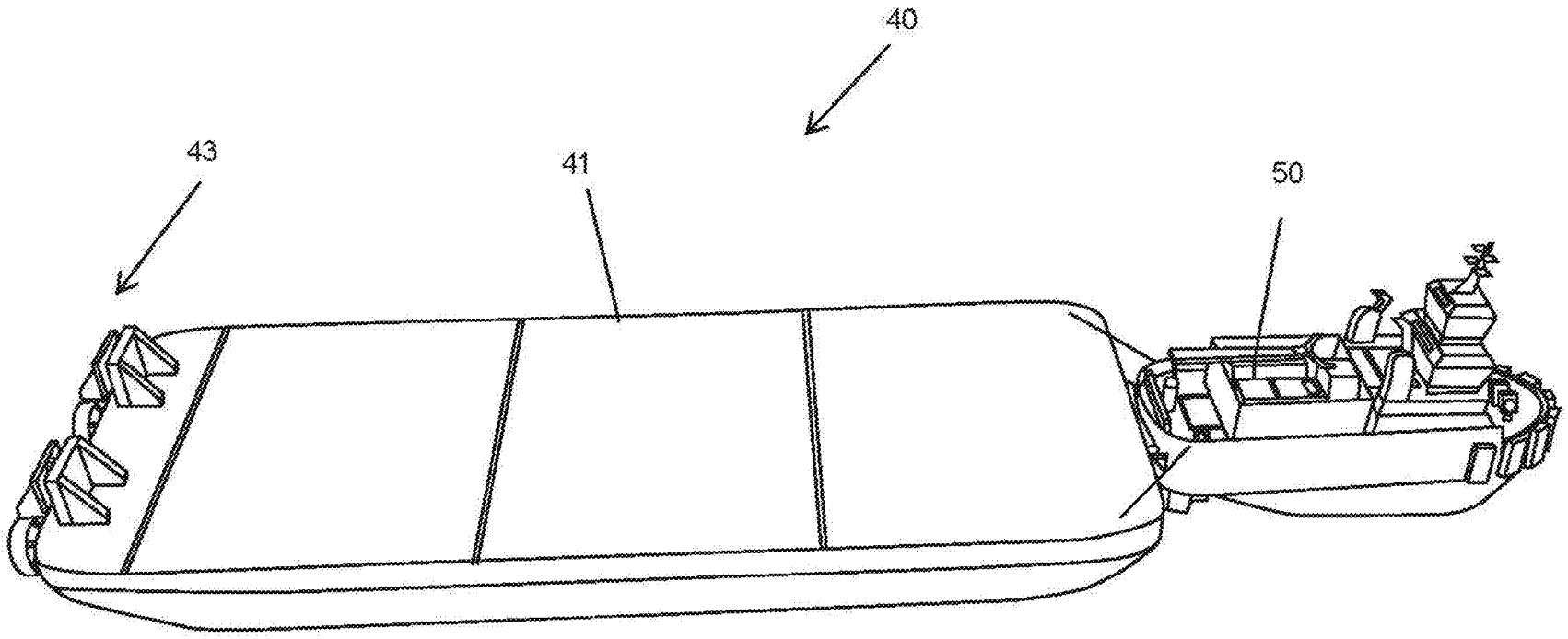
Figure 10:
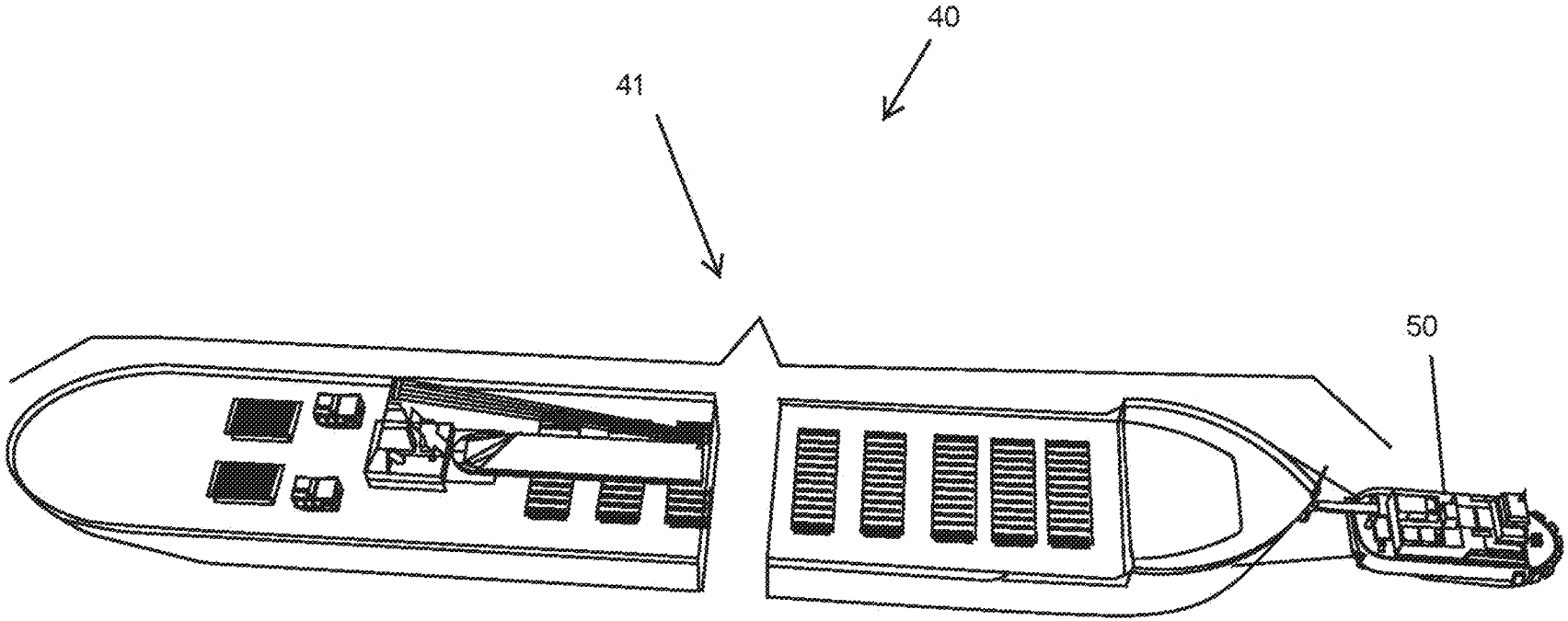
Figure 11:
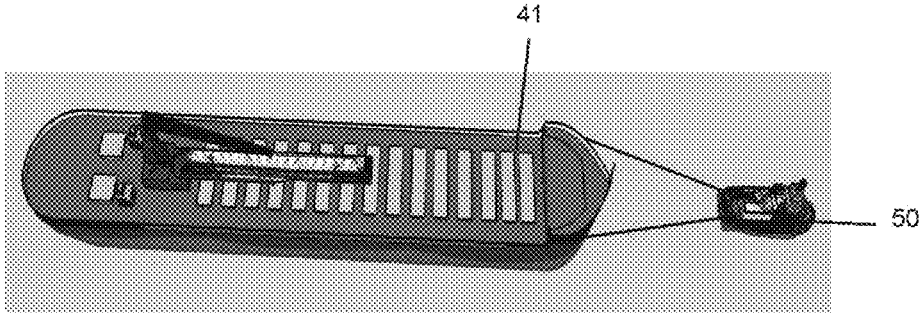
Figure 12:
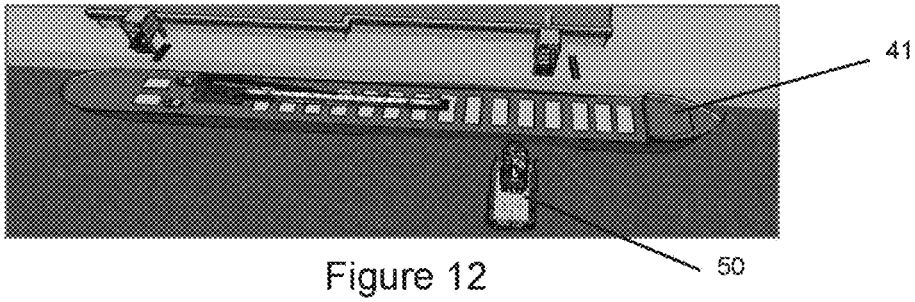
Figure 13:
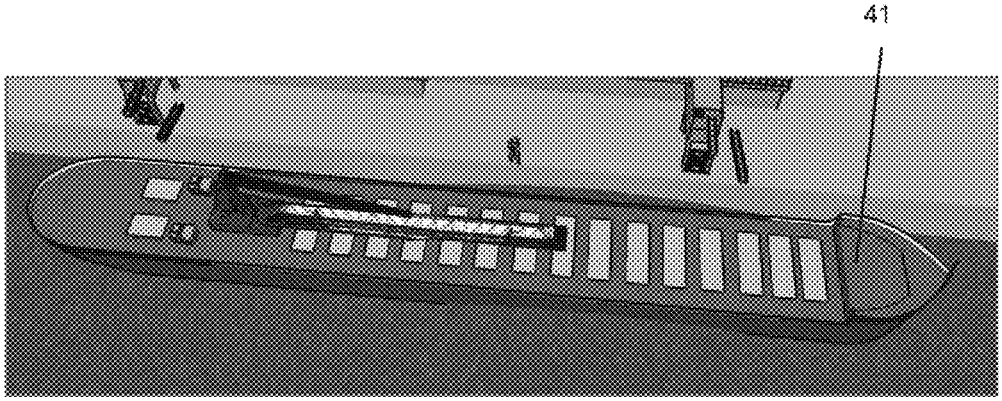
Figure 14:
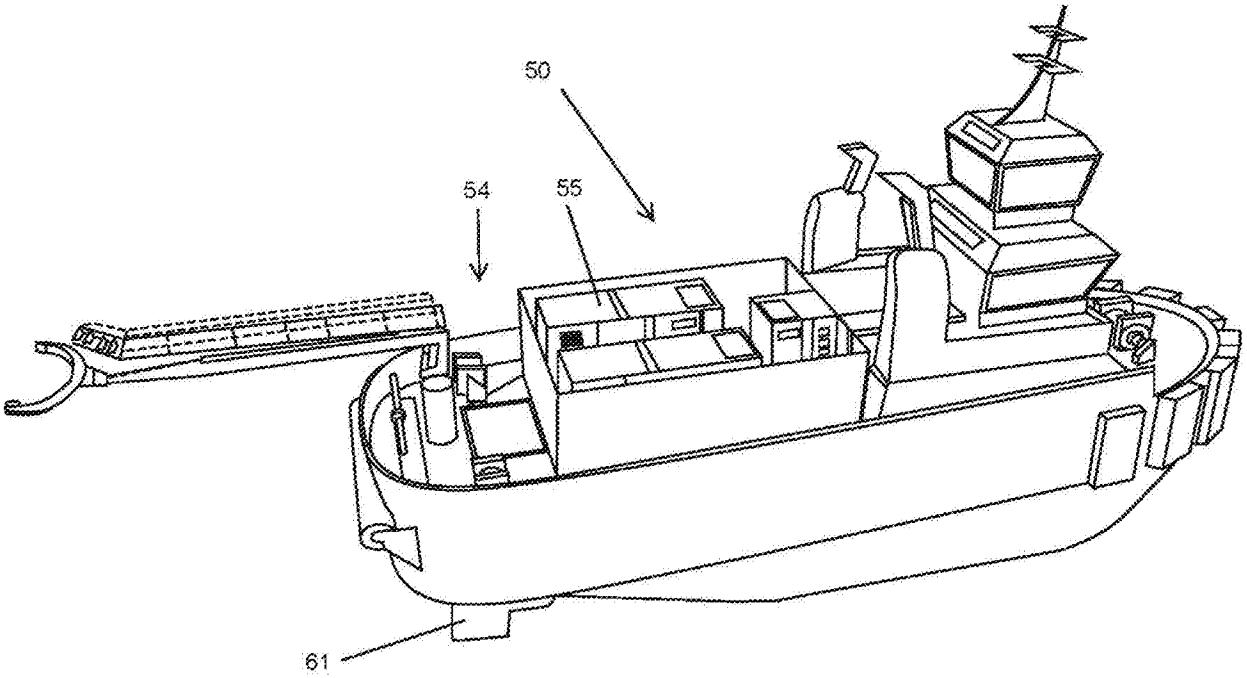
Figure 15:
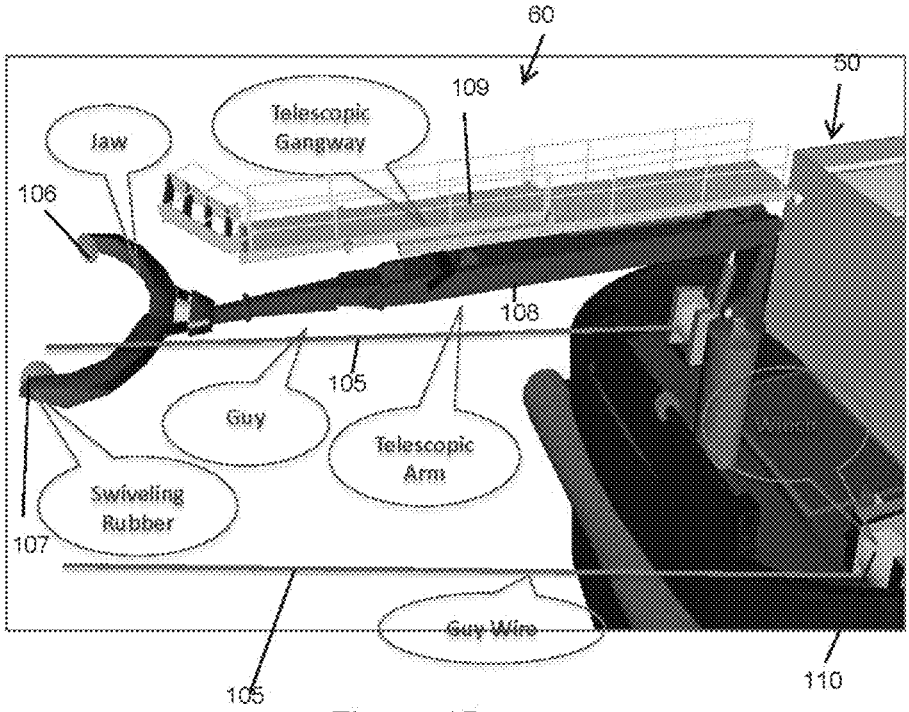
Figure 16:
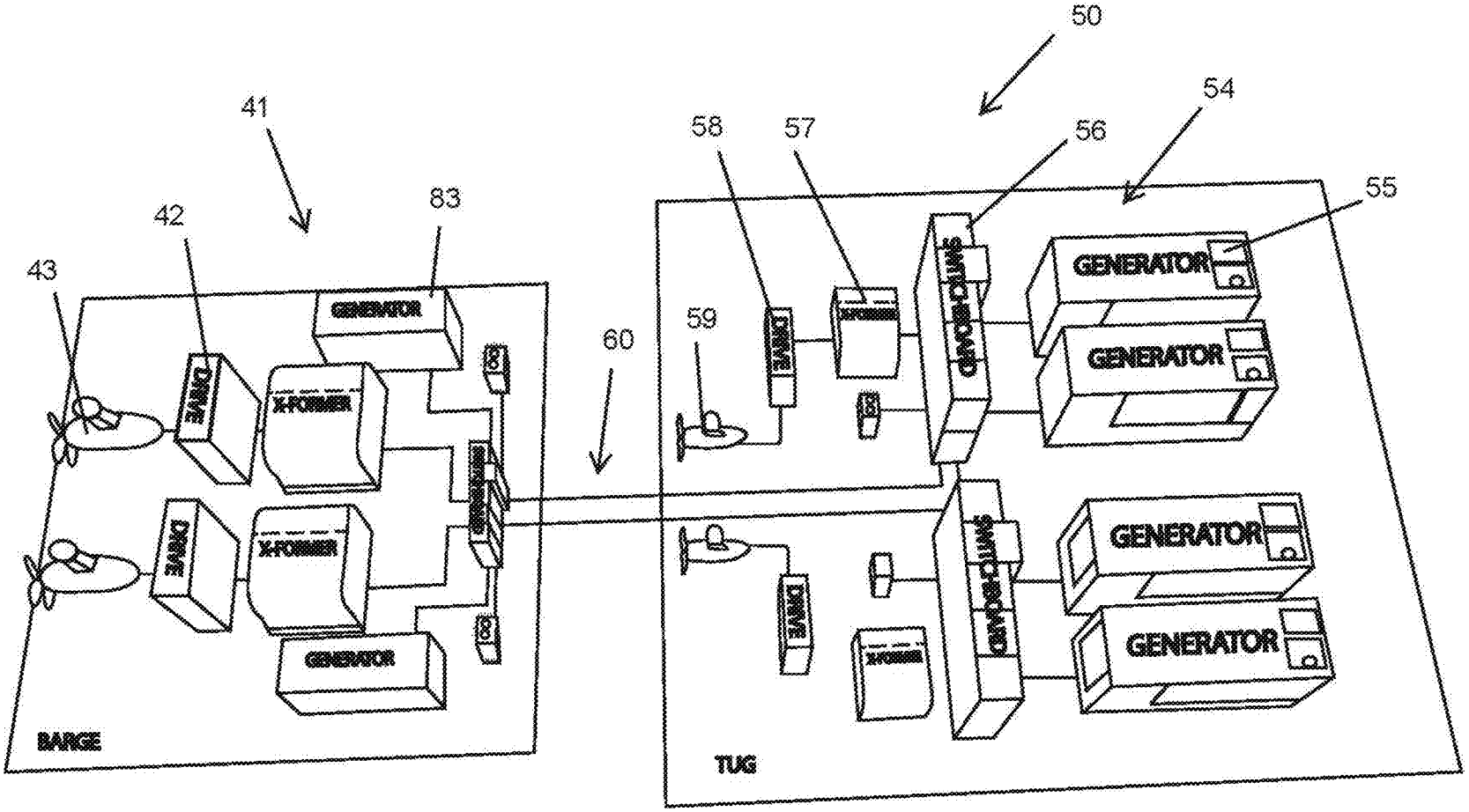
Figure 17:
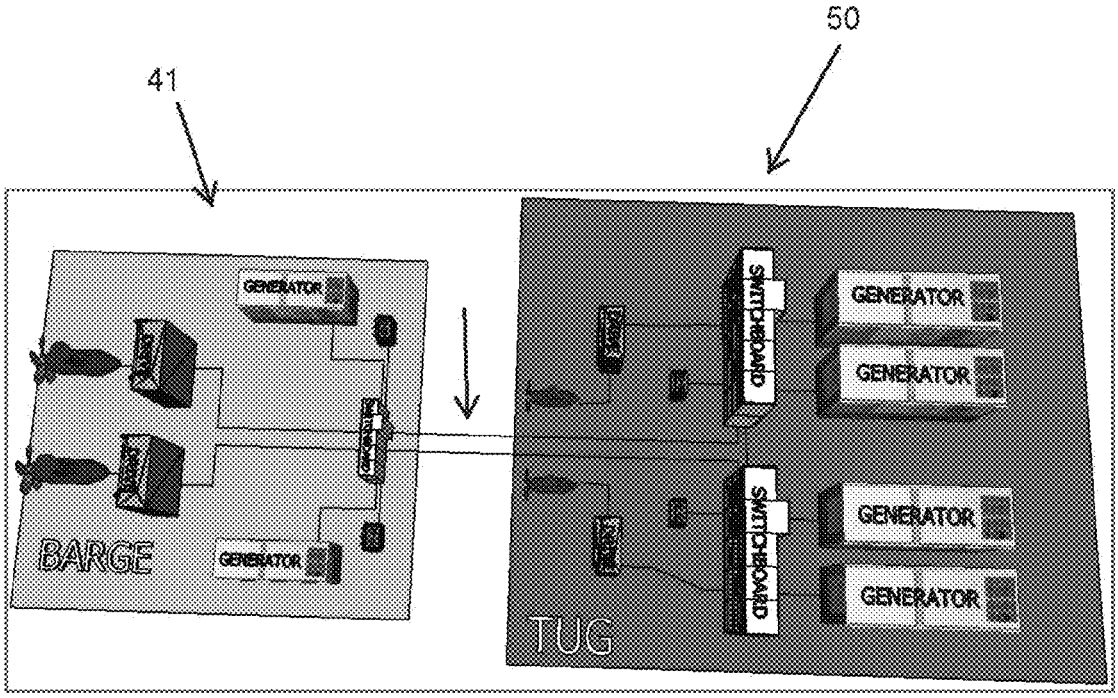
Figure 18:
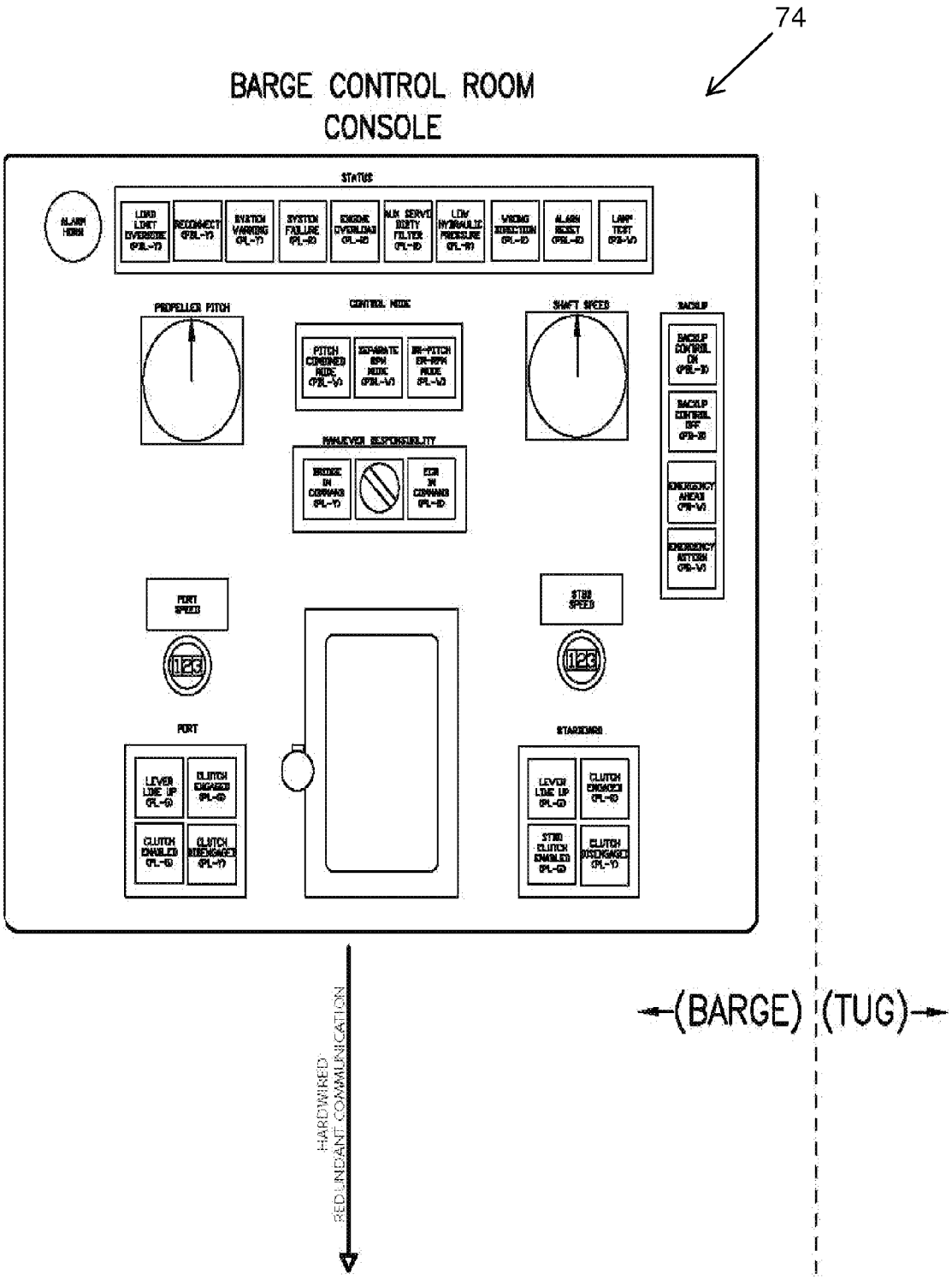
FIGURE 18 (PRIOR ART)
Figure 19:
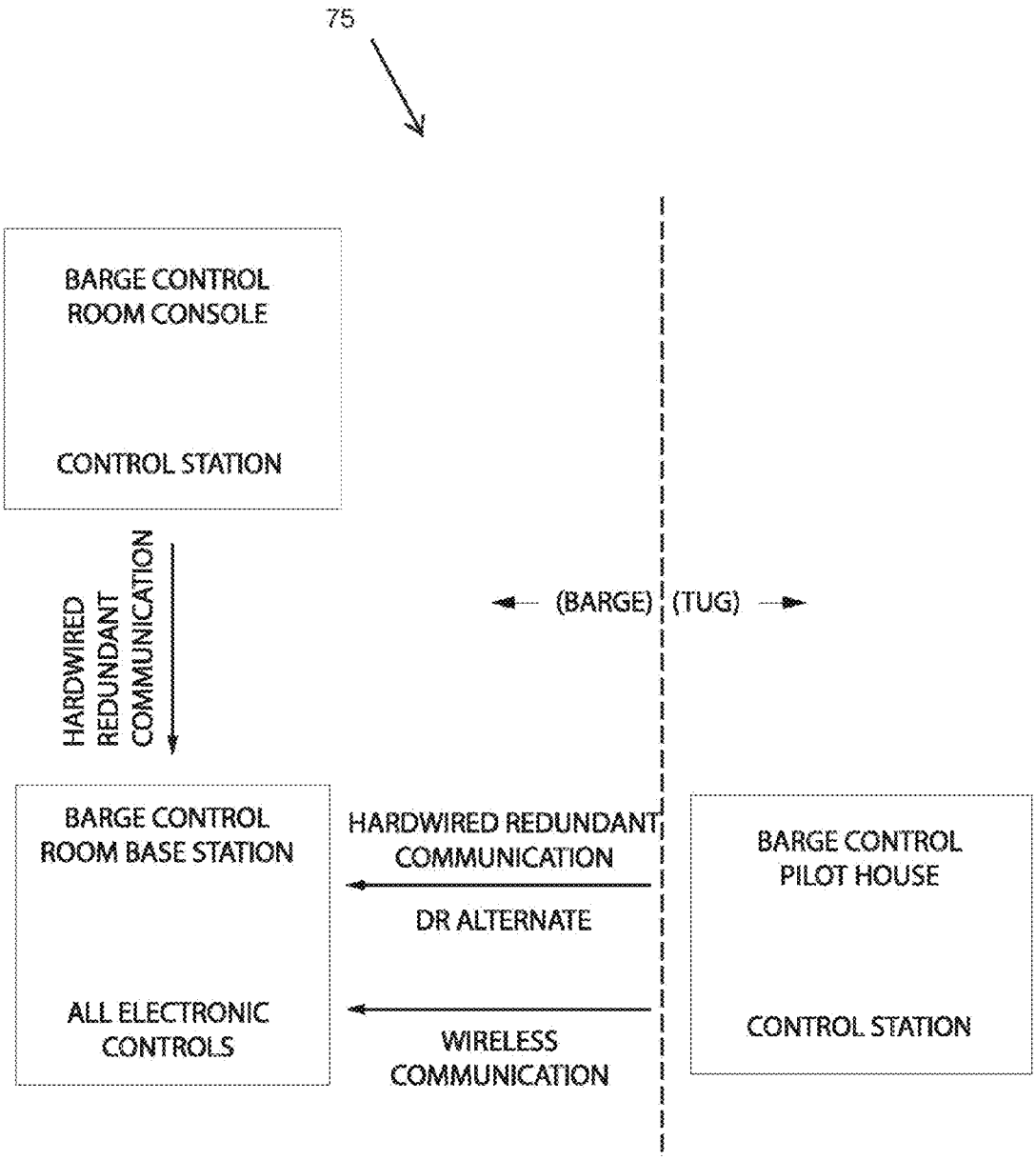
Figure 20:
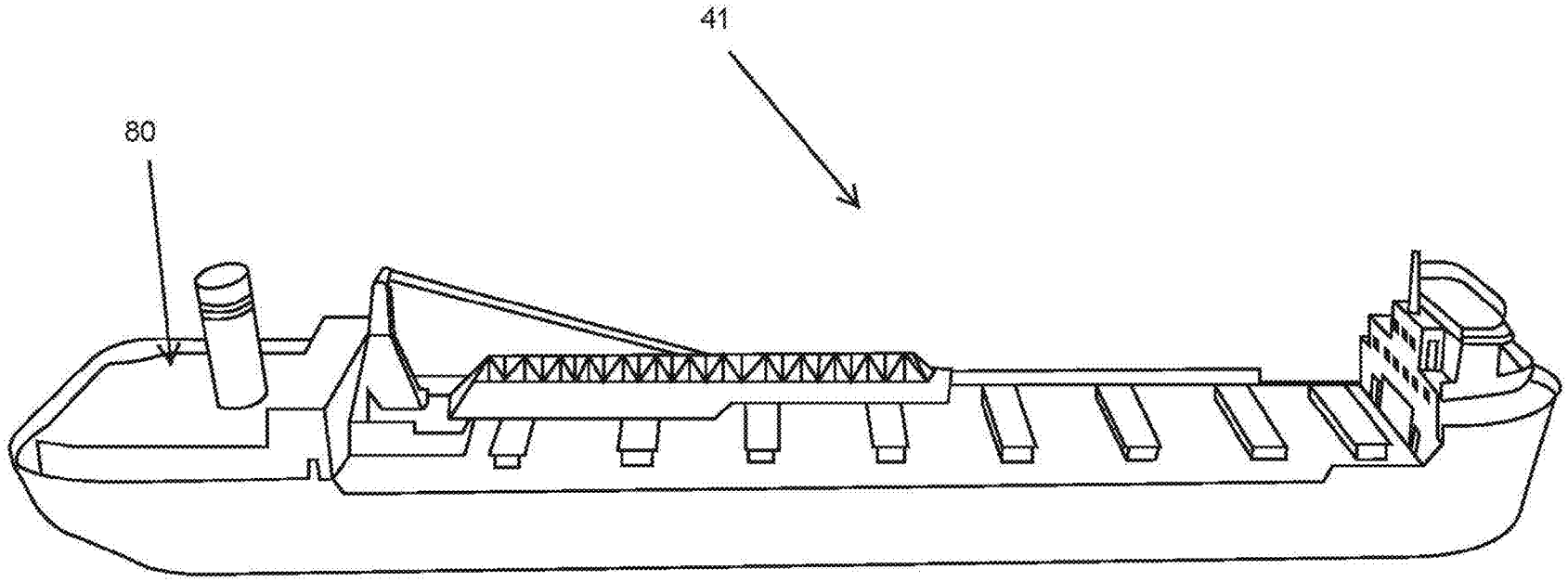
Figure 21:
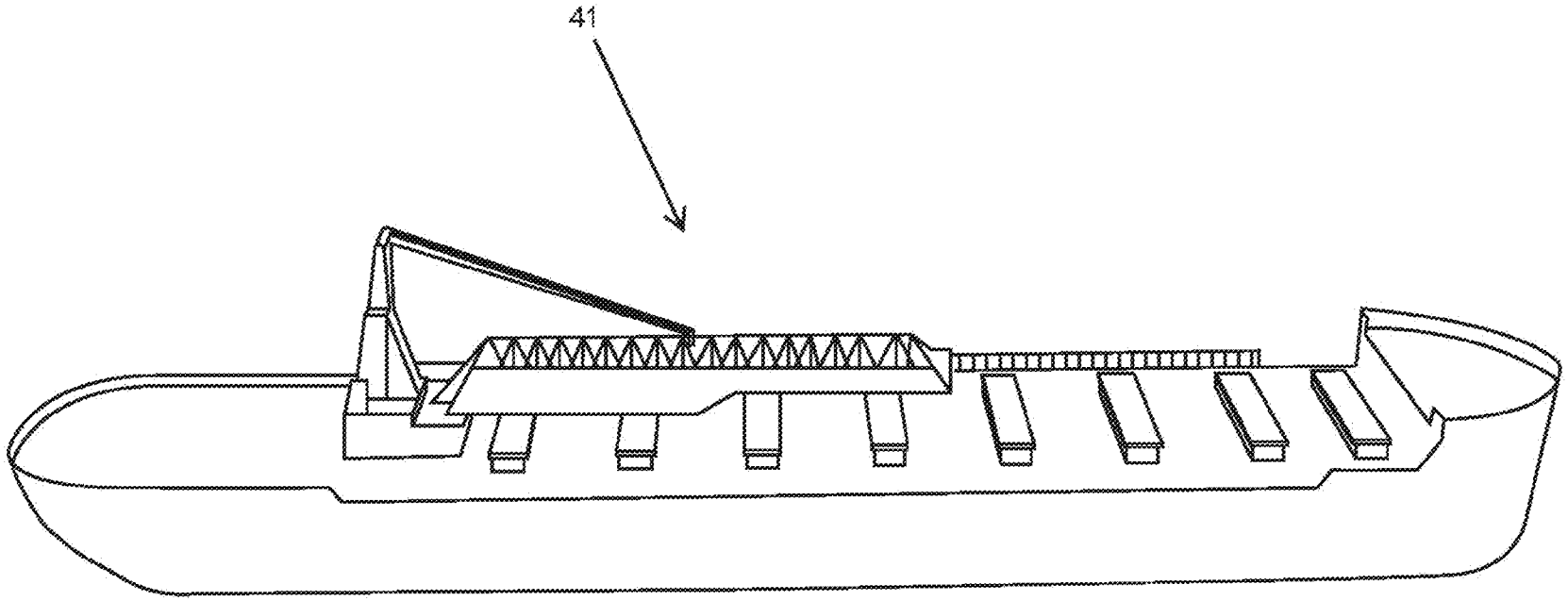
Figure 22:
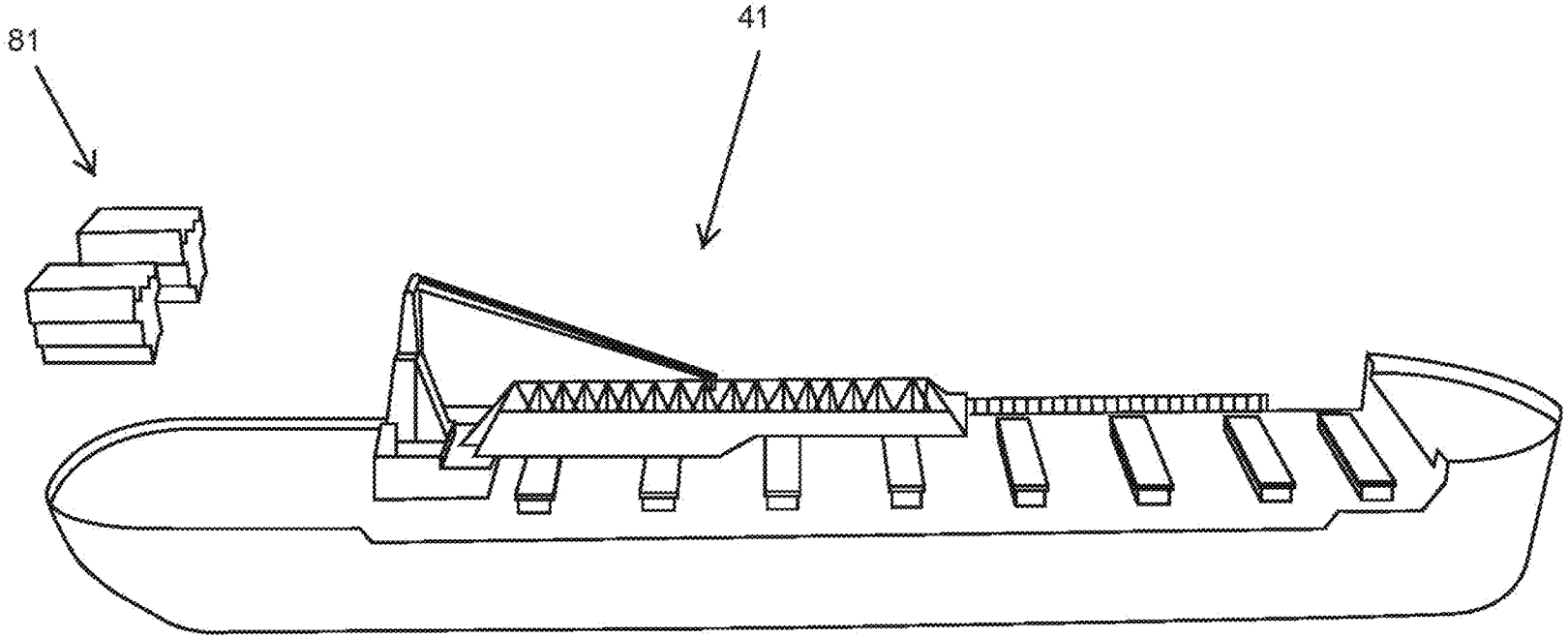
Figure 23:
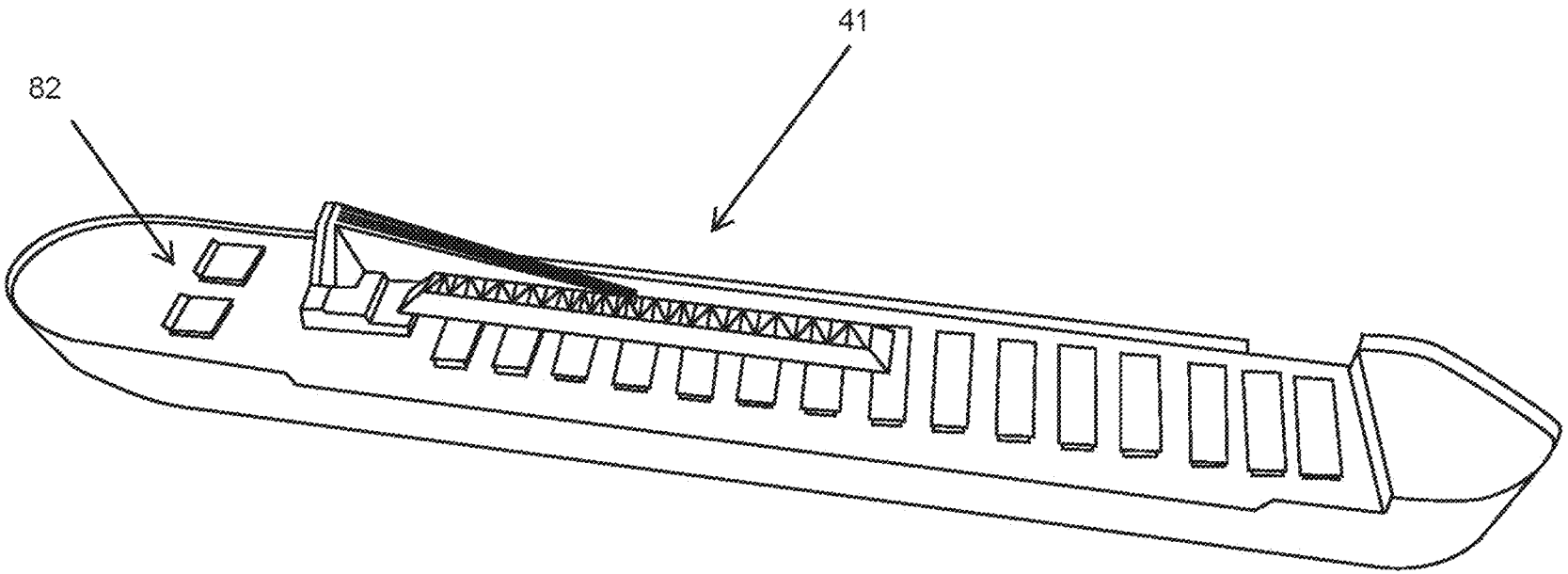
Figure 24:
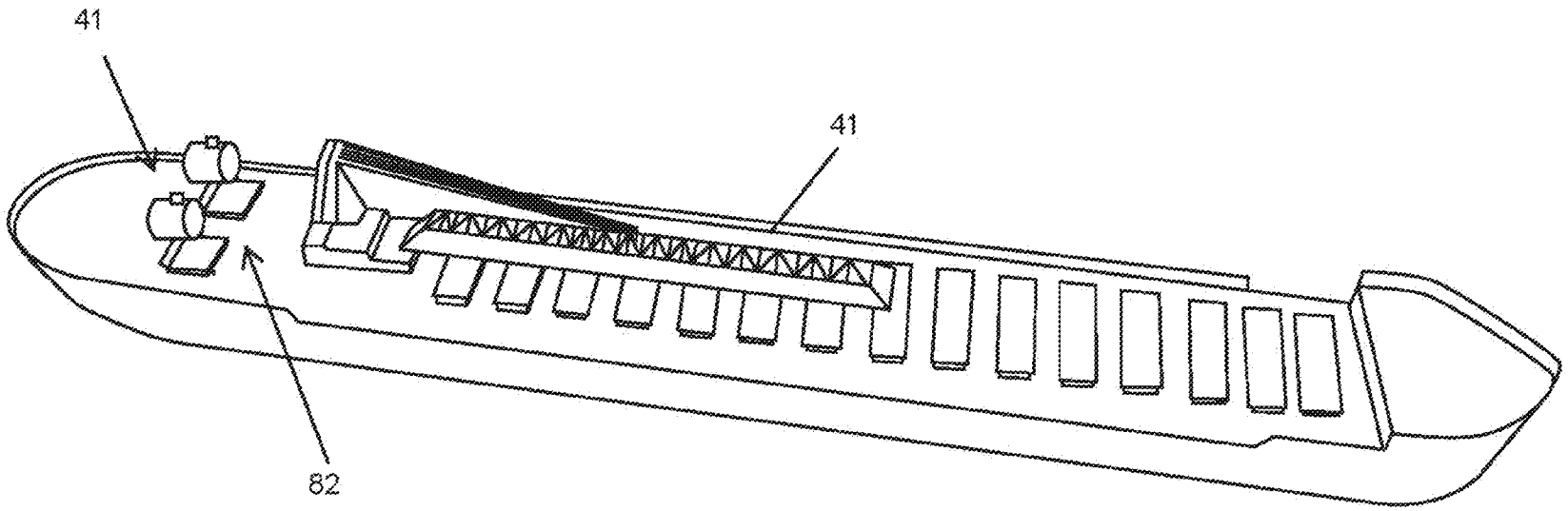
Figure 25:
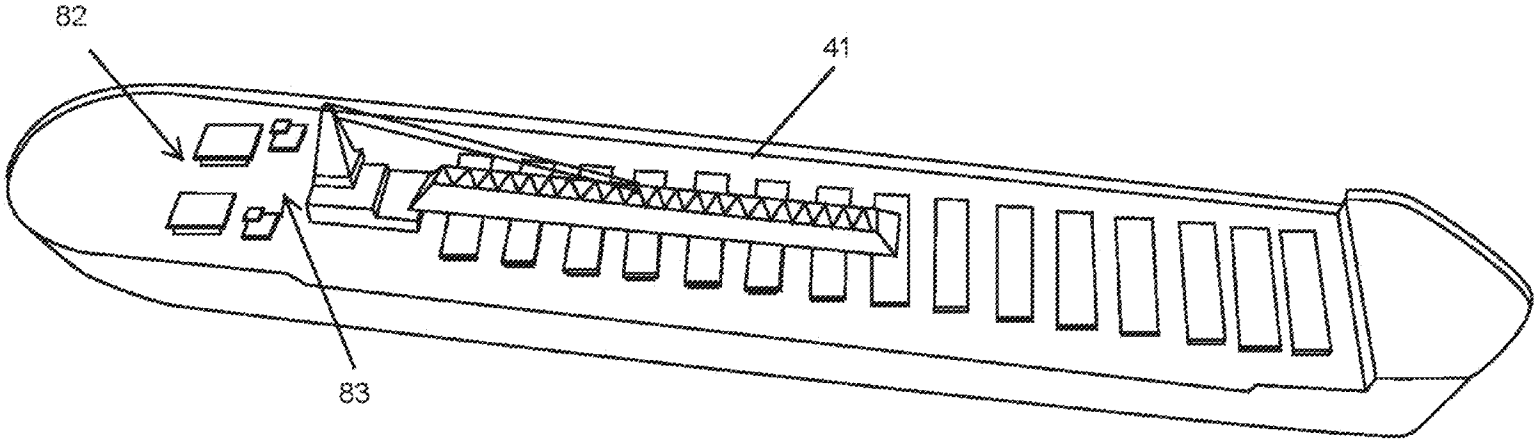
Figure 26:
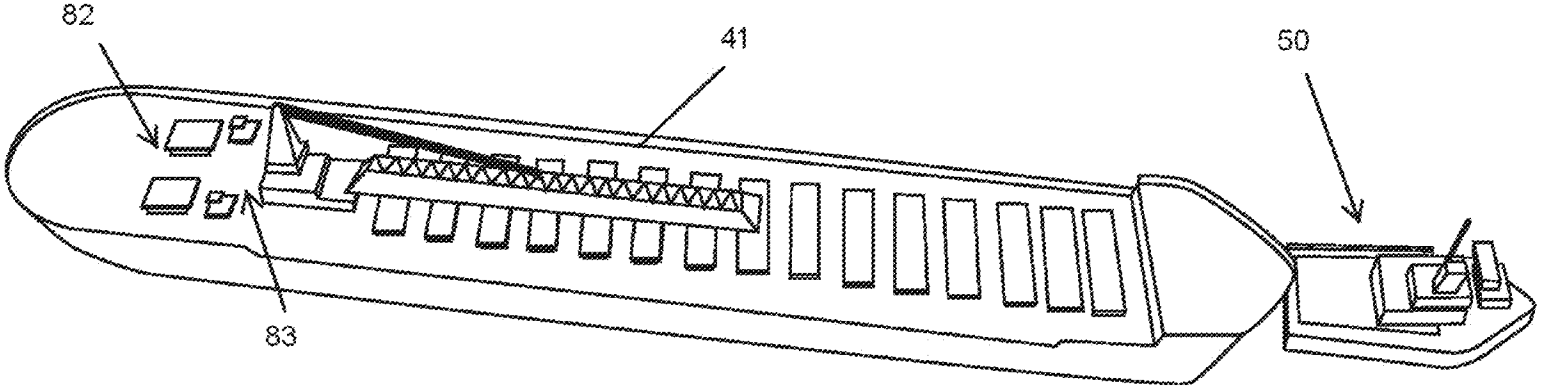
Figure 27:
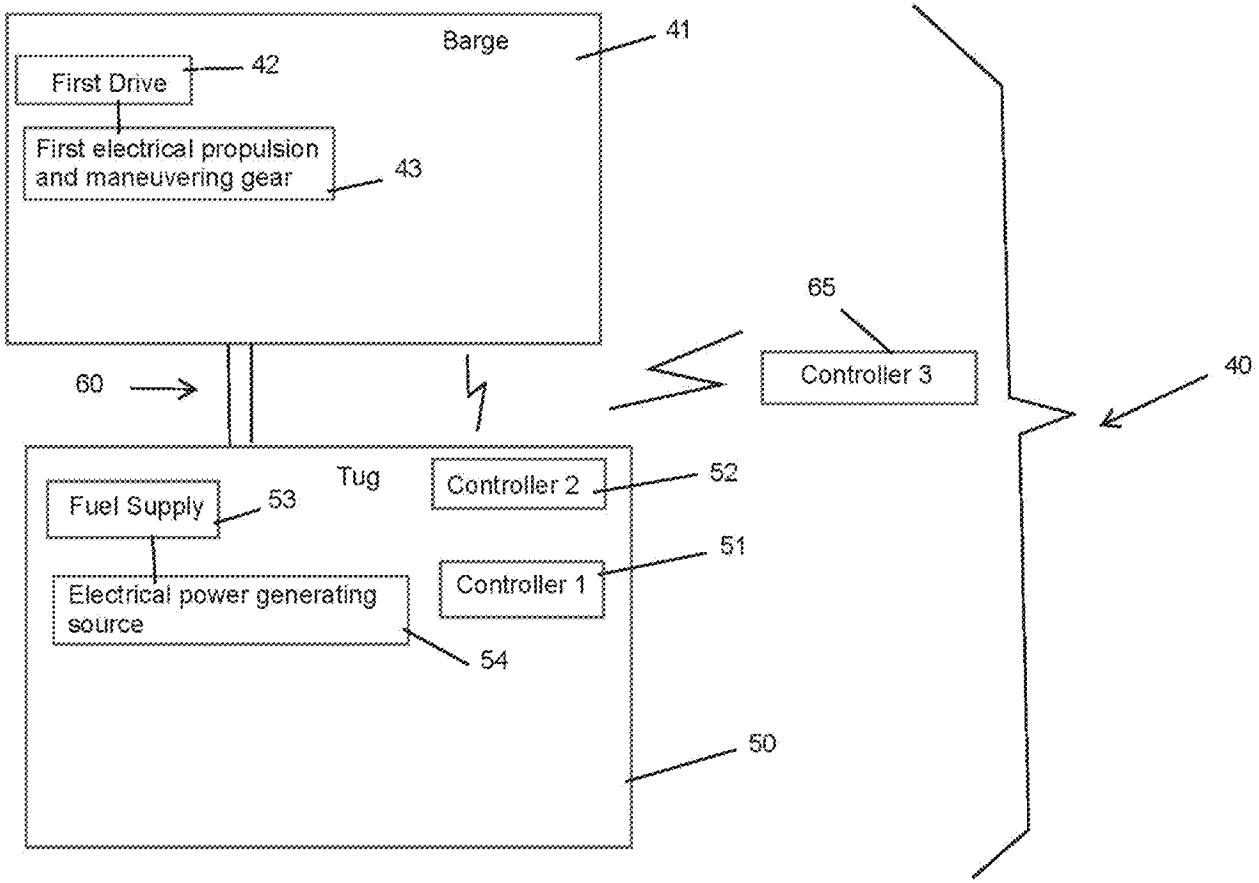

FIG. 5*a* is a perspective view of a conventional propulsion gear configuration for a conventional barge (prior art);

FIG. 6 is a perspective view of a line-of-sight issue in conventional ATB/ITB systems;

FIG. 7 is a perspective view of a conventional tug with a high pilothouse and high center of gravity that becomes tender/unstable (prior art);

FIG. 8 is a high-level schematic diagram of a new propulsion system employing a powerhouse boat, in accordance with a non-limiting exemplary embodiment of the present disclosure;

FIG. 9 is a perspective view of a non-limiting exemplary floating structure that can be propelled by the new powerhouse boat propulsion system illustrated in FIG. 8;

FIG. 10 is a perspective view of a non-limiting exemplary powerhouse tug-barge system in normal operations where the tug is working as a powerhouse and the barge is pushing the tug with its propulsion power;

FIG. 11 is a perspective view of a non-limiting exemplary powerhouse tug-barge system in a towing mode wherein the powerhouse tug uses its own propulsion to tow the barge in rough weather (an emergency generator onboard the barge may add to propulsion power of barge);

FIG. 12 is a perspective view of a non-limiting exemplary powerhouse tug employed in barge berthing operations wherein the powerhouse tug uses its own propulsion to assist the barge dock;

FIG. 13 is a perspective view of a non-limiting exemplary barge being remotely controlled from a dock wherein an operator on dock is berthing the barge with a remote control while the powerhouse tug is engaged in other services;

FIG. 14 is a perspective view of a non-limiting exemplary powerhouse tug employing a trunk filled with generators along with a connection system and electric azimuth;

FIG. 15 is a perspective view of a non-limiting exemplary soft articulation system employed by the powerhouse tug illustrated in FIG. 14;

FIG. 16 is a schematic block diagram of a non-limiting exemplary 6.6 kilovolt amps (KVA) propulsion power source for use with various non-limiting exemplary embodiments of the powerhouse tug and barge propulsion system of the present disclosure;

FIG. 17 is a schematic block diagram of a non-limiting exemplary 3.3 (KVA) propulsion power source for use with various non-limiting exemplary embodiments of the new powerhouse tug and barge propulsion system of the present disclosure;

FIG. 18 is a top plan view of a conventional control system panel employed by a ATB system, which is employed by various non-limiting exemplary embodiments of the new powerhouse tug and barge propulsion system of the present disclosure;

FIG. 19 is a high level schematic diagram of the control system panel illustrated in FIG. 18;

FIG. 20 is a perspective view of a conventional traditional self-unloading vessel employing an existing superstructure configuration (Prior Art);

FIG. 21 is a perspective view of the vessel illustrated in FIG. 20 wherein the existing superstructure configuration is removed therefrom;

FIG. 22 is a perspective view of the vessel illustrated in FIG. 21 wherein the existing propulsion engine(s) is removed therefrom;

FIG. 23 is a perspective view of the vessel illustrated in FIG. 22 wherein a modified smaller machinery hatch(es) is installed thereon, in accordance with a non-limiting exemplary embodiment of the present disclosure;

FIG. 24 is a perspective view of the vessel illustrated in FIG. 23 wherein propulsion motor(s) is installed on the hatches, in accordance with a non-limiting exemplary embodiment of the present disclosure;

FIG. 25 is a perspective view of the vessel illustrated in FIG. 24 wherein skid-mounted generator(s) is installed on the deck for providing power to cargo gears and for providing emergency power to a powerhouse tug propulsion/maneuvering system, in accordance with a non-limiting exemplary embodiment of the present disclosure;

FIG. 26 is a perspective view of the vessel illustrated in FIG. 25 wherein the powerhouse tug propulsion/maneuvering system is communicatively coupled to the skid-mounted generator(s), in accordance with a non-limiting exemplary embodiment of the present disclosure; and FIG. 27 is a high-level block diagram showing the interrelationship between the major components of the PTB propulsion system, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF THE DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment (s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

The terms "powerhouse system," "PTB propulsion system," "powerhouse propulsion system," "PTB system" and variations thereof are interchangeably used throughout the present disclosure. The terms "barge," "vessel" and variations thereof are interchangeably used throughout the present disclosure. The terms "powerhouse/tug," "tug," "tug boat" and variation thereof are interchangeably used throughout the present disclosure.

The multi-functional powerhouse tug and barge (PTB) propulsion system 40 provides an unexpected and unpredictable benefit because its design utilizes electric propulsion in the barge 41 and a tug boat 50 with at least one generator for generating power and serving as a power pack. This concept has two basic differences with traditional ATB systems. First, though the barge 41 will have electrical propulsion gear onboard, the propulsion power will come from the tug 50, acting as a powerhouse (e.g., power supply source, power plant, etc.). Secondly, the powerhouse tug 50 will be connected at the bow of the barge 41 rather than at the stern and will be pushed by the barge 41 when the barge 41 is propelling. The control will be onboard the powerhouse tug 50.

This concept will have the propulsion and operational advantage of a ship compounded with the commercial advantages of a tug & barge system. The greatest advantage of this concept is that the tug 50 can be designed to serve as a traditional tow boat, pusher in an ATB configuration, as well as a powerhouse tug 50 in a PTB configuration, serving all kinds of barges 41 (vessels) while the barge 41 can be designed for the highest propulsive efficiency with ship shape stern.

Non-limiting exemplary embodiments of the present disclosure are referred to generally in the figures and are intended to provide a multi-functional powerhouse tug boat 50 employed in an PTB propulsion system 40 for providing power to the barge 41 (vessel) via a power-pack onboard the tug 50. It should be understood that the exemplary embodiment(s) may be used to tow a variety of barges 41, and should not be limited to any particular barge 41 described herein.

In non-limiting exemplary embodiment(s), conversion of an existing self-propelled vessel preferably includes removal of the accommodations and engine(s) while leaving the propulsion gears (shaft & propeller) intact. Now that we have a barge 41 with electric propulsion gear, it only needs power to run. Traditionally we would have installed an engine or electric motor(s) with generators for a self-propelled manned vessel or use a tug 50.

Under this new concept we will use electric propulsion onboard the barge 41 without a prime-mover and will use a powerhouse tug 50 with generators connected by a soft connection 60 at the bow of the barge 41 to supply the propulsion power required by the barge 41.

This concept has two basic differences with traditional ATB and ITB systems. First, the barge 41, unlike the traditional ATB or ITB configurations, will not only have electrical propulsion gears onboard, it will be operated from the powerhouse boat, which also will supply the propulsion power to the barge 41. Secondly, the powerhouse boat will be connected at the bow of the barge 41 with a soft connection 60 rather than pushing at stern of the barge 41 like in a traditional ATB system 40. The powerhouse boat will also have its own propulsion gear to be quickly disconnected and converted to a tug 50 boat on an emergency or for independent operations.

A PTB propulsion system 40 including a barge 41 having a first drive 42, and a first electrical propulsion and maneuvering gear 43 in communication with the first drive (drive) 42. A tug 50 is in electrical communication with the barge 41 and detachably coupled thereto. Such a tug 50 includes a first controller 51 in operative communication with the first drive 42, a second controller 52, a fuel supply 53, and an electrical power generating source 54 communicatively coupled to the fuel supply 53. The electrical power generating source 54 is in operative communication with the second controller 52 for controlling its own propulsion system independently from the barge 41. Notably, a soft connection 60 physically and electrically couples the tug 50 to the barge 41 such that the tug 50 is pushed and maneuvered by the barge 41. Advantageously, the electrical power generating source 54 is configured to transfer power to the first drive 42 thereby driving the first electrical propulsion and maneuvering gear 43 such that the barge 41 does not need an onboard power source for independently supplying power to the first drive 42. The electrical power generating source 54 may also be referred to herein as a "power pack" or "power plant."

In a non-limiting exemplary embodiment, the electrical power generating source 54 includes a generator 55, a switch board 56 in communication with the generator 55 and located downstream therefrom, and a transformer 57 in communication with the generator 55 and located downstream therefrom.

In a non-limiting exemplary embodiment, the electrical power generating source 54 further includes a drive 58 in communication with the transformer 57 and located downstream therefrom, and a second electrical propulsion and maneuvering gear 59 in communication with the drive 58 and located downstream therefrom. Notably, the first electrical propulsion and maneuvering gear 43 is independently controlled from the second electrical propulsion and maneuvering gear 59.

In a non-limiting exemplary embodiment, the second electrical propulsion and maneuvering gear 59 includes an electric azimuth system 61.

In a non-limiting exemplary embodiment, the fuel supply 53 includes a non-conductive energy source.

In a non-limiting exemplary embodiment, the non-conductive energy source includes liquid natural gas.

In a non-limiting exemplary embodiment, the PTB propulsion system 40 further includes a third controller 65 remotely located from the first controller 51 and the second controller 52. Such a third controller 65 is in communication with the first controller 51 and the second controller 52 for selectively controlling an operating mode of the first electrical propulsion and maneuvering gear 43 as well as the second electrical propulsion and maneuvering gear 59.

The present disclosure further includes a method for utilizing a powerhouse tug and barge (PTB) propulsion system 40 for providing power from a tug 50 to a barge 41. Such a method includes the steps of: providing a barge 41 having a first drive 42, and a first electrical propulsion and maneuvering gear 43 in communication with the first drive 42; providing a tug 50 in electrical communication with the barge 41 such that the barge 41 is detachably coupled to the tug 50. Such a tug 50 includes a first controller 51 in operative communication with the first drive 42. The tug 50 also includes a second controller 52, a fuel supply 53, and an electrical power generating source 54 communicatively coupled to the fuel supply 53. The electrical power generating source 54 is in operative communication with the second controller 52 so that the tug 50 controls its own propulsion independently from propelling the barge 41.

The method further includes the steps of: providing a soft connection 60 and thereby physically and electrically coupling the tug 50 to the barge 41 such that the tug 50 is pushed and maneuvered by the barge 41; and the electrical power generating source 54 transferring power to the first drive 42 thereby driving the first electrical propulsion and maneuvering gear 43 such that the barge 41 does not need an onboard power source for independently supplying power to the first drive 42.

FIG. 8 is a high-level schematic diagram of the new PTB propulsion system 40 employing a powerhouse boat 50, in accordance with a non-limiting exemplary embodiment of the present disclosure. In this new concept, the barge 41 with virtually no superstructure 80 (e.g., tower, power source, etc.) and notch will be designed with a regular ship hull and will be equipped with electrical propulsion gears 43 but no propulsion power source. Instead of a tug 50 pushing from the stern in a notch, a powerhouse/tug 50 will be placed at the bow using a soft connection 60. The barge 41 will be designed as efficient as possible from the advantage of larger stern and deeper draft compared to a tug 50. The barge 41 electrical propulsion and maneuvering gears 43 will be powered by the powerhouse tug 50 at the bow. The powerhouse tug 50 will preferably be equipped with containerized generators 55 and will also be fitted with its own electrical propulsion gears 59 for flexible and independent operations. The barge 41 may have generators 83 for its cargo gears which may also serve as emergency power source to its thrusters and/or propulsion system. Wireless control options for these equipment types will make it more flexible in operation.

The powerhouse tug 50 will also be fitted with its own propulsion gears 59 for independent operations. In case the propulsive system onboard the barge 41 fails or the weather is too rough the powerhouse tug 50 will switch to self-propelled mode, move forward by taking off the soft articulation and paying off the guy wire 105 attached to the barge 41 and tow the barge 41 like a conventional tug 50. With this self-propelling option it may also work as a docking tug 50 for its parent barge 41 or any other vessel. The barge 41 may be equipped with bow and stern thrusters/pump jets.

For new construction, the propulsion gear 59 may be an electric azimuth system 61 with a thruster or pump jet (to assist in both maneuvering and propulsion) at the bow of the tug 50. Remotely operated and controlled diesel generators 55 may be installed on the barge 41 to power the onboard systems, like the cargo gears, which may also be used in case of emergency to remotely propel the barge 41 when the tug 50 is not connected to it. This can also be used to power the propulsive or maneuvering gears 59 for additional propulsive power in towing mode. New barges may be designed to have bunker tanks for fueling the tug 50 for increased endurance. They may also be fitted with azimuth drives (fixed or retractable) to avoid stern thruster to achieve better maneuvering and maintenance efficiency. Enough space will be available onboard the vessel 41 to store battery banks for hybrid propulsion system, if need be. Liquid natural gas (LNG) option may also be applied by arranging the LNG bunkers onboard the barge 41 with smaller tanks onboard the powerhouse tug 50 to be replenished on demand. A marine LNG engine is a dual fuel engine that uses natural gas and bunker fuel to convert chemical energy in to mechanical energy.

As usual a new concept will only be acceptable if it has:

A. Technical Advantage.

B. Operational Advantage; and

C. Commercial Advantage over the existing systems; and get

D. Regulatory Acceptance.

Technical Advantage

Vessels designed with this new concept will have:

1. Increased propulsive efficiency due to:
   a. Maximization of propulsive gear size on the barge 41 than one possible on the tug 50;
   b. Tug 50 at forward end resulting in added length & better angle of entrance;
   c. Reduced tug 50-barge 41 transitional loss; and
   d. Better design of the stern of the barge 41.
2. It will need a smaller and simpler articulation system as now the barge 41 is pushing the small tug 50 compared to a traditional ATB system where a smaller tug 50 pushes a large vessel needing stronger pin system.
3. This concept can be applied to both existing vessels and new constructions.
4. Powerhouse/tug 50 with propulsion gears will be suitable for independent operation.
5. Electric propulsion system can be run at wide range of rpm and power output.
6. Barge 41 with wireless-controlled generators 83 and other gears 43 will be suitable for emergency operations from different bases.
7. Flexible fuel system can also be used for the generators 55, 83. The barge 41 will have enough spare space for LNG tanks for bunkering.

Operational Advantages

Vessels applying this new concept will have following operational advantages:

1. Will have no line of sight issue.
2. Will have greater flexibility in operation:
   a. in ATB configuration; and
   b. can quickly switch to towing/pushing/berthing mode:
      i. in rough weather; or
      ii. in case of failed propulsion on the barge 41; or
      iii. for the tug 50 to be used for barge 41 docking or other commercial operation.
3. The powerhouse tug 50 and barge 41 can be used as independent units for greater utilization.
4. Remote operation of the barge 41 will be possible from powerhouse tug 50 or from shore.
5. Generators 55 on the tug 50 and propulsion gears 59, 43 on both tug 50 and barge 41 can be replaced easily when required for repair/maintenance or environmental compliance.

FIG. 9 is a perspective view of a non-limiting exemplary floating structure that can be propelled by the new PTB propulsion system 40 illustrated in FIG. 8. Thus, the new concept of the present disclosure can also be applied to any barge 41 or floating structure where portable or temporary propulsion system can be installed and a powerhouse tug 50 can be added to propel the system, if there is an overall economic advantage. The powerhouse tug 50 can also work as a self-propelled floating power station. The powerhouse tug 50 can also be used as conventional tug-barge system 40 where a set of barges 41 can be handled by a smaller set of tugs 50 in a "drop and swap" principle which minimizes the turnaround time in port for the tug 50 and its crew. In addition to reducing unprofitable waiting time such operation principle allows more time for the unloading of the barge 41, removing the need for expensive cargo handling equipment in the unloading port.

Non-limiting exemplary embodiments are described hereinbelow. For example, FIG. 10 is a perspective view of a non-limiting exemplary powerhouse tug-barge system 40 in normal operations where the tug 50 is working as a powerhouse and the barge 41 is pushing the tug 50 with its propulsion power. In normal operation the powerhouse tug 50 will be connected at the bow with soft articulation and guy cables 105 from towing winches and power the propulsion gears 43 onboard the barge 41.

FIG. 11 is a perspective view of a non-limiting exemplary powerhouse tug-barge system 40 in a towing mode wherein the powerhouse tug 50 uses its own propulsion to tow the barge 41 in rough weather (an emergency generator onboard the barge 41 may add to propulsion power of barge 41). For rough weather operations the soft articulation will be taken off. The powerhouse tug 50 will switch to its own propulsion power and move forward by paying off the guy cables 105 to work as a tow boat.

FIG. 12 is a perspective view of a non-limiting exemplary powerhouse tug 50 employed in barge 41 berthing operations wherein the powerhouse tug 50 uses its own propulsion to assist the barge 41 dock. When the barge 41 is brought near the dock powerhouse/tug 50 can be disconnected from the barge 41 and be used for berthing the barge 41 with no requirement for extra tug 50 assist.

FIG. 13 is a perspective view of a non-limiting exemplary barge 41 being remotely controlled from a dock wherein an operator on dock is berthing the barge 41 with a remote control while the powerhouse tug 50 is engaged in other services. Thus, a shore based operator can also berth the barge 41 with remote control while powerhouse tug 50 can leave for other commercial operations.

Commercial Advantages—

Some of the most significant commercial advantages are listed below:

Smaller Crewing Need.

For example if we take a 35000 dwt cargo vessel with say 730 ft $L_{oa}$, 78 ft $B_{mld}$, 45 ft $D_{mld}$ the crew need will be: 22 as per regulations. On the other hand for the same capacity of 35000 dwt on tug-barge system 40 of the same size of a barge 41 crew need is only: 13 as per regulations. This is around 41% reduction in crew requirement. The math is simple, with 41% reduction in crew number the crew cost is also 41% down on direct expenses. Of course there are savings in indirect expenses, too, when the crew number goes down.

Lower Freeboard, Resulting in Increased Cargo Capacity.

Freeboard assignment for an unmanned barge 41 is up to 25% less than that of a manned barge 41 (vessel). That means depending on draft restriction compared to a manned vessel the barge 41: will be smaller in overall cubic size; may maximize its propulsion system size due to deeper draft; will be cheaper in hull cost; and will have increased cargo capacity for the same size of a regular vessel. Say for 730 ft $L_{oa}$, 78 ft $B_{mld}$, 45 ft $D_{mld}$ with 27.5 ft draft the capacity of a manned vessel is: 35000 dwt. For the same size of unmanned barge 41 with 25% reduction in freeboard assignment, the draft can be 31.75 ft, at which the barge 41 may carry around: 41400 dwt. Which is 18.25% increase in cargo capacity. The math is again simple, with 18.25% increase in capacity the revenue increase is also 18.25%.

Other advantages include:

1. Smaller machinery space in the barge 41, thus increased cargo capacity.
2. Higher propulsive efficiency in this configuration, saving fuel.
3. Need of cheaper articulation system.
4. No notch needed on the barge 41 saving significant investment.
5. Increased utility & reduced downtime from the build-in flexibility.
6. This concept applied to both existing vessels or new constructions.
7. Will save a number of vessels from ending up with wreckers.
8. Additional fuel bunkers can be added in the barge 41 from reduced need for machinery space for higher tug 50 endurance.
9. No superstructure needed on the barge 41.
10. Low overall cost.
11. Quicker return on investment.
12. The powerhouse boat 50 can be commercially used as a self-propelled floating power station.

Regulatory Acceptance—

Some of the most significant commercial advantages are listed below. There are no obvious issues for the regulatory bodies not to accept this new concept because No new science or technology development will be involved in: Propulsion gear design; articulation system design; Electrical power transmission & quick disconnect design; and control system design.

TABLE 1

NEW PROPULSION SYSTEM 40 CONCEPT DEVELOPMENT

| SI# | Traditional Tug 50-Barge 41 System 40 | Traditional Self-propelled Vessels | Conclusion for New concept |
|---|---|---|---|
| 1 | Tug has smaller draft and thus has a size restriction for its propulsion gear, which makes it less efficient with smaller propeller and propulsion power. | Traditional Vessels has larger draft and engine room space to accommodate larger engine and propeller, thus achieving higher propulsive efficiency. | For better propulsion efficiency with the option of a bigger propeller (azimuth drive for new build) and prime-mover they will be installed on the vessel rather than a smaller one possible on tug boat. |
| 2 | Being connected behind a wide barge the tug's propulsive efficiency is largely affected by the hydrodynamic disturbances caused by the barge in front. | Aft section of the traditional vessel can be designed to be more streamlined to achieve higher propulsive efficiency compared to the one for the tug in a tug-barge system. | The tug to be in the forward end of the vessel resulting in added length streamlining the water flow for better angle of entrance for higher propulsive efficiency. |
| 3 | Propulsive power comes from | Propulsive power comes from | Propulsion gear will be part of the vessel, but the |

TABLE 1-continued

NEW PROPULSION SYSTEM 40 CONCEPT DEVELOPMENT

| SI# | Traditional Tug 50-Barge 41 System 40 | Traditional Self-propelled Vessels | Conclusion for New concept |
|---|---|---|---|
| | the tug pushing from behind the vessel where high propulsive efficiency cannot be achieved. | the vessel where high propulsive efficiency can be achieved. | power will come from the tug at the bow working as a powerhouse. |
| 4 | As the smaller tug pushes a big barge, it needs a strong and robust connection system between the tug and the barge. | Not applicable for traditional vessel. | Bigger vessel will push a smaller tug and the connection between them does not have to be robust. |
| 5 | There is no propulsion system in the barge. Once the barge is separated from the tug, the tug can still be propelled but the barge cannot be propelled by itself. | Not applicable for traditional vessel. | The powerhouse tug will also be equipped with propulsion system (preferably retractable azimuth) which will work as a towboat when separated. This will be useful during rough weather and also serve the parent vessel or other vessel as a tug boat. The vessel will also have remote controlled generators onboard for cargo gears that will be used for emergency operation of remote controlled propulsion gear and thruster/s. |
| 6 | Because of the size of the barge in front, the tugs line of sight causes severe navigational constraints. Some of these tugs have very high wheelhouse, making it uncomfortable for the crews and restricting its navigation under some bridges. | Not applicable for traditional vessel. | The tug in front will have no line of sight issue and will not need a higher pilothouse. |

In fact, companies like GE®, ABB®, and SIEMENS®, etc. are already supplying all the above technologies.

1. It will have more flexibility in operations.
2. It is more safer than existing ATB/ITB systems; and there will be
3. Not much needed to be added to existing regulation.

Below is a general comparison between traditional tug-barge system 40 and the new concept:

New Powerhouse Tug and Barge Propulsion System 40

FIG. 14 is a perspective view of a non-limiting exemplary powerhouse tug 50 employing a trunk filled with generators 55 along with a connection system and electric azimuth 61. A typical powerhouse tug 50 under this concept may have an electrical azimuth drive. The portable and stackable generators 55 can be on the lower deck levels in a trunk-type housing, lowering the center of gravity of the tug 50. Automation in the system will add in or take out generators 55 as per load demand, same as in the shore based power generation plants. The top trunk cover will be removable.

FIG. 15 is a perspective view of a non-limiting exemplary a soft articulation (soft connection 60) employed by the powerhouse tug 50 illustrated in FIG. 14. A possible soft articulation (soft connection 60) to connect to the barge 41 may have a hydraulically operated flexible jaw 106 with swiveling suction cups 107 or rubber paddings at the tip, installed on a fixed or telescopic arm 108, pinned on the tug 50 deck with universal joint. There may be a fixed or telescopic gangway 109 over the arm for commuting between the tug 50 and the barge 41. This gangway 109 may land on platforms at multiple levels on the barge 41 having watertight access doors.

Two guy wires 105 from tow winches 110 on the sides of the powerhouse tug 50 at the aft deck will also be connected to the barge 41. In bad weather the articulation and the electrical connection between the tug 50 and barge 41 will be taken off and the powerhouse tug 50 will switch to its own propulsion system to work a tug 50. The winches 110 will pay off the guy cables 105 out and the tug 50 now will move forward to tow the barge 41.

FIGS. 16 and 17 are schematic block diagrams of non-limiting exemplary 6.6 and 3.3 kilovolt amps (KVA), respectively, propulsion power source for use with various non-limiting exemplary embodiments of the powerhouse tug and barge propulsion system 40 of the present disclosure. FIG. 16 shows a typical machinery arrangement in a 6.6 KVA power generation and propulsion system while FIG. 17 is showing the same for a 3.3 KVA system 40.

A typical control system 74 onboard the barge 41 and the powerhouse tug 50 is shown in FIG. 18 while FIG. 19 shows a schematic diagram 75 of the same system. FIG. 18 is a top plan view of a conventional control system 74 panel employed by a conventional ATB system (Prior Art), which is employed by various non-limiting exemplary embodiments of the new powerhouse tug and barge propulsion system 40 of the present disclosure. FIG. 19 is a high level schematic diagram 75 of the control system panel 74 illustrated in FIG. 18.

EXAMPLES

Non-limiting exemplary embodiment(s) of the present disclosure can be applied to existing vessels for retrofit as well as for new construction and will be highly flexible to cater different operating scenarios. In addition to the propulsion system onboard the barge 41 the tug 50 will also be installed with diesel-electric propulsion system for flexibility in operations. In rough weather or in case of failed propulsion gears on the barge 41, the propulsion may be switched to the tug 50, which now can be separated from the barge 41 for pulling it as a regular tug 50. With this option the tug 50 can also work independently for docking the barge 41 or serving other vessels.

Existing Vessels Retrofit Based on the New Concept

The primary modification for existing vessels will include removal of the accommodation and propulsion engines from the existing vessels, converting it into an unmanned carrier like a barge 41 with no propulsion engine. Keeping the accommodations on top replacement of engines is a very costly endeavor, as it may have to be done on a dry dock and by cutting the side of the vessel. The engine is usually removed in small pieces that can be handled inside the vessel. If there is no accommodation above the engine room it will much economical to remove the engine(s) in one piece. So if we do not require the accommodation, removal of both the accommodation as a block and then the engine(s) in one piece would make more economic sense. Please note that there is scrap value for both the accommodation and the engine(s) and its associated accessories. FIGS. 20-26 show typical steps in the retrofit of an existing vessel.

FIG. 20 is a perspective view of a conventional traditional self-unloading vessel 41 employing an existing superstructure 80 configuration. FIG. 21 is a perspective view of the vessel illustrated in FIG. 20 wherein the existing superstructure 80 configuration is removed therefrom. FIG. 22 is a perspective view of the vessel 41 illustrated in FIG. 21 wherein the existing propulsion engine(s) 81 is removed therefrom. FIG. 23 is a perspective view of the vessel 41 illustrated in FIG. 22 wherein a modified smaller machinery hatch(es) 82 is installed thereon, in accordance with a non-limiting exemplary embodiment of the present disclosure. FIG. 24 is a perspective view of the vessel 41 illustrated in FIG. 23 wherein propulsion drive(s) 42 is installed on the hatches 82, in accordance with a non-limiting exemplary embodiment of the present disclosure.

FIG. 25 is a perspective view of the vessel 41 illustrated in FIG. 24 wherein skid-mounted generator(s) 83 is installed on the deck for providing power to cargo gears and for providing emergency power to a powerhouse tug 50 propulsion/maneuvering gear 59, in accordance with a non-limiting exemplary embodiment of the present disclosure. FIG. 26 is a perspective view of the vessel 41 illustrated in FIG. 25 wherein the powerhouse tug 50 electrical power generating source 54 is communicatively coupled to the skid-mounted generator(s) 83, in accordance with a non-limiting exemplary embodiment of the present disclosure.

FIG. 27 is a high-level block diagram showing the interrelationship between the major components of the PTB propulsion system 40, in accordance with a non-limiting exemplary embodiment of the present disclosure. It can be seen that the barge 41 does not include a power source. Rather, electrical power is generated at the tug 50 and transferred to the barge 41. In turn, the barge 41 pushes and maneuvers the tug 50 through the water. Optionally, the tug 50 may have its own propelling and maneuvering system 59 (e.g., FIG. 16) to operate in the water when the barge 41 is not available to push and maneuver the tug 50.

The investment on the retrofit of the vessel 41 and addition of the powerhouse tug 50 may still prove to be economical because of high return rate from increased cargo capacity and operational flexibility. This retrofit concept will save a number of vessels from ending up with wreckers and help the increased need for vessels to cope up with decreasing draft at waterways like that of Great Lakes etc.

Constraints

Two main challenges will be designing of a safe articulated connection between the powerhouse tug 50 and the barge 41 with a quick disconnecting power line and acceptance by regulatory bodies and classification societies of this new concept. Maximum sea state condition will have to be suggested for this operation, beyond which the tug 50 will have to be switched to tow mode to tow the barge 41 with its own propulsive gear 59. As discussed before, regulatory acceptance should not be an issue, because this system 40 will be way safer than the existing ones and no new science and technology development is involved. Only a tug 50 working as electrical power-pack for the barge 41 will work with this system 40. Alternatively, a conventional tug 50 may be used to tow the barge 41 in case of major barge system failure.

Adopting this new PTB propulsion system 40 will help in bringing back-to-service a number of vessels laid off for operational, environmental compliance and commercial reasons. The flexibility in operation will make it more economical by reducing crew numbers and tug 50 assists. Common to the introduction of all new concepts, it may be hard to conceptualize this initially, but as soon as the benefits of this concept will be more obvious, this concept will be accepted very easily, especially when this will help in bringing back to service the laid off vessels.

While non-limiting exemplary embodiment(s) has/have been described with respect to certain specific embodiment (s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A powerhouse tug and barge (PTB) propulsion system for providing power from a tug to a barge, said PTB propulsion system comprising:

a barge including
- a first drive, and
- a first electrical propulsion and maneuvering gear in communication with said first drive;

a tug in electrical communication with said barge, said tug including
- a first controller in operative communication with said first drive,
- a second controller,
- a fuel supply, and an electrical power generating source communicatively coupled to said fuel supply, said electrical power generating source being in operative communication with said second controller; and a connection physically and electrically coupling said tug to said barge such that said tug is pushed and maneuvered by said barge;

wherein said electrical power generating source is configured to transfer power to said first drive thereby driving said first electrical propulsion and maneuvering gear such that said barge does not have an onboard power source for independently supplying power to said first drive.

2. The PTB propulsion system of claim 1, wherein said electrical power generating source comprises:

a generator;

a switch board in communication with said generator and located downstream therefrom; and a transformer in communication with said generator and located downstream therefrom.

3. The PTB propulsion system of claim 2, wherein said electrical power generating source further comprises:

a drive in communication with said transformer and located downstream therefrom; and a second electrical propulsion and maneuvering gear in communication with said drive and located downstream therefrom;

wherein said first electrical propulsion and maneuvering gear is independently controlled from said second electrical propulsion and maneuvering gear.

4. The PTB propulsion system of claim 3, wherein said second electrical propulsion and maneuvering gear comprises: an electric azimuth system.

5. The PTB propulsion system of claim 1, wherein said fuel supply comprises: a non-conductive energy source.

6. The PTB propulsion system of claim 5, wherein said non-conductive energy source comprises: liquid natural gas.

7. The PTB system of claim 3, further comprising: a third controller remotely located from said first controller and said second controller, said third controller being in operative communication with said first controller for selectively controlling an operating mode of said first electrical propulsion and maneuvering gear onboard said barge and further being in operative communication with said second controller for selectively controlling an operating mode of said second electrical propulsion and maneuvering gear onboard said tug.

8. A powerhouse tug and barge (PTB) propulsion system for providing power from a tug to a barge, said PTB propulsion system comprising:

a barge including a first drive, and a first electrical propulsion and maneuvering gear in communication with said first drive;

a tug in electrical communication with said barge and being detachably coupled thereto, said tug including a first controller in operative communication with said first drive, a second controller, a fuel supply, and an electrical power generating source communicatively coupled to said fuel supply, said electrical power generating source being in operative communication with said second controller; and a connection physically and electrically coupling said tug to said barge such that said tug is pushed and maneuvered by said barge;

wherein said electrical power generating source is configured to transfer power to said first drive thereby driving said first electrical propulsion and maneuvering gear such that said barge does not have an onboard power source for independently supplying power to said first drive.

9. The PTB propulsion system of claim 8, wherein said electrical power generating source comprises:

a generator;

a switch board in communication with said generator and located downstream therefrom; and a transformer in communication with said generator and located downstream therefrom.

10. The PTB propulsion system of claim 9, wherein said electrical power generating source further comprises:

a drive in communication with said transformer and located downstream therefrom; and a second electrical propulsion and maneuvering gear in communication with said drive and located downstream therefrom;

wherein said first electrical propulsion and maneuvering gear is independently controlled from said second electrical propulsion and maneuvering gear.

11. The PTB propulsion system of claim 10, wherein said second electrical propulsion and maneuvering gear comprises: an electric azimuth system.

12. The PTB propulsion system of claim 8, wherein said fuel supply comprises: a non-conductive energy source.

13. The PTB propulsion system of claim 12, wherein said non-conductive energy source comprises: liquid natural gas.

14. The PTB system of claim 10, further comprising: a third controller remotely located from said first controller and said second controller, said third controller being in operative communication with said first controller for selectively controlling an operating mode of said first electrical propulsion and maneuvering gear onboard said barge and further being in operative communication with said second controller for selectively controlling an operating mode of said second electrical propulsion and maneuvering gear onboard said tug.

15. A method for utilizing a powerhouse tug and barge (PTB) propulsion system for providing power from a tug to a barge, said method comprising the steps of:

providing a barge including a first drive, and a first electrical propulsion and maneuvering gear in communication with said first drive;

providing a tug in electrical communication with said barge and being detachably coupled thereto, said tug including a first controller in operative communication with said first drive, a second controller, a fuel supply, and an electrical power generating source communicatively coupled to said fuel supply, said electrical power generating source being in operative communication with said second controller;

providing a connection and thereby physically and electrically coupling said tug to said barge such that said tug is pushed and maneuvered by said barge; and said electrical power generating source transferring power to said first drive thereby driving said first electrical propulsion and maneuvering gear such that said barge does not have an onboard power source for independently supplying power to said first drive.

* * * * *